US011094272B2

(12) United States Patent
Shiibayashi

(10) Patent No.: US 11,094,272 B2
(45) Date of Patent: Aug. 17, 2021

(54) DISPLAY DRIVER AND SEMICONDUCTOR APPARATUS

(71) Applicant: LAPIS Semiconductor Co., Ltd., Yokohama (JP)

(72) Inventor: Kenichi Shiibayashi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/923,013

(22) Filed: Jul. 7, 2020

(65) Prior Publication Data

US 2021/0012731 A1 Jan. 14, 2021

(30) Foreign Application Priority Data

Jul. 9, 2019 (JP) ..... JP2019-127448

(51) Int. Cl.
*G09G 3/36* (2006.01)

(52) U.S. Cl.
CPC ..... *G09G 3/3614* (2013.01); *G09G 3/3666* (2013.01); *G09G 3/3685* (2013.01); *G09G 2310/0291* (2013.01); *G09G 2310/08* (2013.01); *G09G 2320/043* (2013.01); *G09G 2320/0646* (2013.01)

(58) Field of Classification Search
CPC ..... G09G 3/3614; G09G 3/3666; G09G 2310/0291; G09G 2310/08; G09G 2320/043; G09G 2320/0646; G09G 2310/0243; G09G 3/3275; G09G 3/3685
See application file for complete search history.

(56) References Cited

U.S. PATENT DOCUMENTS 6,914,587 B2 * 7/2005 Kosaka ..... G09G 3/3688 345/215
9,070,342 B2 * 6/2015 Wu ..... G09G 3/3685
10,964,279 B2 * 3/2021 Bansho ..... G09G 3/3258
2004/0113880 A1 * 6/2004 Honda ..... G09G 3/3685 345/96
2008/0001876 A1 * 1/2008 Ito ..... G09G 3/3655 345/87
2008/0204439 A1 * 8/2008 Morita ..... G09G 3/3688 345/209
2010/0020114 A1 * 1/2010 Lee ..... G09G 3/3688 345/690
2013/0127806 A1 * 5/2013 Wu ..... G09G 3/3688 345/211
2015/0310812 A1 * 10/2015 Chen ..... G09G 3/20 345/691
2016/0063915 A1 * 3/2016 Kim ..... G09G 3/3685 345/209
2020/0098297 A1 * 3/2020 Heo ..... G09G 3/20

FOREIGN PATENT DOCUMENTS

JP H10143116 A 5/1998

* cited by examiner

*Primary Examiner* — Antonio Xavier
(74) *Attorney, Agent, or Firm* — Rabin & Berdo, P.C.

(57) ABSTRACT

A display driver according to the present invention includes a withstand voltage protection part that precharges an output node of a polarity changeover switch circuit that switches a polarity of a drive signal supplied to a display device from an electric potential of a positive polarity (a first electric potential to a third electric potential) to an electric potential of a negative polarity (the third electric potential to a second electric potential) or vice versa to the third electric potential immediately before the polarity switching.

7 Claims, 17 Drawing Sheets

DISPLAY DRIVER AND SEMICONDUCTOR APPARATUS

CROSS-REFERENCE TO RELATED APPLICATION

This application claims the benefit of Japan Application No. 2019-127448, filed on Jul. 9, 2019. The entirety of the above-mentioned patent application is hereby incorporated by reference herein and made a part of this specification.

BACKGROUND

1. Technical Field

The present invention relates to a display driver that drives a display device in accordance with an image signal and a semiconductor apparatus in which the display driver is formed.

2. Related Art

For example, in an active matrix type liquid crystal display panel as a display device, a plurality of gate lines that extend in a horizontal direction of a two-dimensional screen and a plurality of data lines that extend in a perpendicular direction of the two-dimensional screen are disposed to intersect. At an intersection between each of the plurality of data lines and each of the plurality of gate lines, a display cell that includes a liquid crystal electrode and a transistor that applies a voltage of the data line to the liquid crystal electrode is formed.

Furthermore, in the liquid crystal display panel, a liquid crystal driving circuit that generates a voltage corresponding to a luminance level for each pixel represented by an input image signal and applies the voltage to each of the data lines is mounted as a display driver (for example, see FIG. 1 in JP-A-10-143116). With the liquid crystal drive circuit, a decoder disposed corresponding to each of the data line converts image data corresponding to the data line into an analog gradation potential. A drive signal obtained by amplifying such a gradation potential with an operational amplifier disposed corresponding to each of the data line is output to the data line of the liquid crystal display panel.

In such a liquid crystal drive circuit, in order to avoid a characteristic degradation of a liquid crystal material in a liquid crystal display panel, polarities (positive polarity and negative polarity) of respective drive signals applied to the liquid crystal electrodes are alternately inverted.

To perform such driving, the liquid crystal drive circuit employs a changeover switch circuit and a plurality of the decoders described below. The changeover switch circuit is provided for each of a pair of operational amplifiers adjacent to one another in a front stage thereof among a plurality of the operational amplifiers disposed to correspond to the respective data lines to switch their polarities.

Odd numbered decoders among the plurality of decoders receive 2ˆn electric potentials that represent an electric potential, which is an electric potential Vcom or less, in 2ˆn levels as negative gradation potentials, and select and output negative gradation potentials corresponding to odd numbered image data among the 2ˆn negative electric potentials. Even numbered decoders receive 2ˆn electric potentials that represent an electric potential, which is the electric potential Vcom or more, in 2ˆn levels as positive gradation potentials, and select and output positive gradation potentials corresponding to even numbered image data among the 2ˆn positive electric potentials.

The changeover switch circuit firstly supplies a negative gradation potential output from an odd numbered decoder to an odd numbered operational amplifier and supplies a positive gradation potential output from an even numbered decoder to an even numbered operational amplifier corresponding to a polarity inversion signal. Next, the changeover switch circuit switches the state to a state where a negative gradation potential output from the odd numbered decoder is supplied to the even numbered operational amplifier and a positive gradation potential output from the even numbered decoder is supplied to the odd numbered operational amplifier.

SUMMARY

The 2ˆn negative gradation potentials and 2ˆn positive gradation potentials supplied to the decoders described above are generated by resistor-dividing between, for example, a single system power supply potential VDD and a ground potential VSS (0 volts) by a ladder resistor or the like. That is, the above-described electric potential Vcom is VDD/2, and 2ˆn electric potentials that are electric potentials in a range of VDD/2 (=Vcom) to VDD divided into n levels are supplied to the even numbered decoders as the positive gradation potentials. Furthermore, the 2ˆn electric potentials that are electric potentials in a range of VSS (0 volts) to VDD/2 (=Vcom) divided into n levels are supplied to the odd numbered decoders as the negative gradation potentials.

This makes a voltage applied to each of the odd numbered and even numbered decoders VDD/2 at the maximum. Accordingly, from an aspect of reducing a size of a circuit size, as the transistors that configure each decoder, it is preferred to employ transistors that regulate the maximum voltage between their drain and source, that is, a withstand voltage to VDD/2.

However, depending on a gradation potential output by the decoder, there is a case where a voltage exceeding the withstand voltage of VDD/2 described above is applied to the decoder when its polarities are switched.

For example, first, assume that the even numbered decoder outputs VDD as a gradation potential and the odd numbered decoder outputs VDD/2 as a gradation potential.

The changeover switch circuit, first, supplies VDD output from the even numbered decoder to an input terminal of the even numbered operational amplifier, and supplies VDD/2 output from the odd numbered decoder to an input terminal of the odd numbered operational amplifier.

This charges an electric charge of VDD to the input terminal of the even numbered operational amplifier and charges an electric charge of VDD/2 to the input terminal of the odd numbered operational amplifier. From that state, the changeover switch circuit switches states to a state where VDD output from the even numbered decoder is supplied to the input terminal of the odd numbered operational amplifier and VDD/2 output from the odd numbered decoder is supplied to the input terminal of the even numbered operational amplifier.

While VDD/2 output from the odd numbered decoder is supplied to the input terminal of the even numbered operational amplifier, since the input terminal of this even numbered operational amplifier is maintained to have VDD until immediately therebefore, a voltage of an output terminal of the odd numbered decoder is pulled up to increase by this VDD from the state of VDD/2.

Accordingly, in the odd numbered decoder, the voltage applied between the input terminal that receives the gradation potential of VSS (0 volts) among the 2^n input terminals receiving respective 2^n gradation potentials in the range of VSS (0 volts) to VDD/2 and the output terminal of this odd numbered decoder exceeds VDD/2 as the withstand voltage of the transistor. Therefore, a service life of the decoder is possibly shortened.

Therefore, it is an objective of the present invention to provide a display driver that ensures achieving a reduced circuit size without shortening a product service life, and a semiconductor apparatus in which the display driver is formed.

A display driver according to the present invention is a display driver that drives a display device in accordance with a plurality of pixel data pieces indicating respective luminance levels of respective pixels based on an image signal. The display driver includes a plurality of driving blocks each of which receives a pair of pixel data pieces among the plurality of pixel data pieces, and generates a pair of drive signals having respective electric potentials corresponding to luminance levels indicated by the pair of pixel data pieces to output the pair of drive signals to the display device. Each of the driving blocks includes a first decoder, a second decoder, a polarity changeover switch circuit, a precharge circuit, and first and second amplifiers. The first decoder receives a plurality of positive gradation voltages each of which has an electric potential in a range from a third electric potential between first and second electric potentials that are mutually different to the first electric potential, and selects a positive gradation voltage corresponding to one of the pair of pixel data pieces among the plurality of positive gradation voltages to output the positive gradation voltage to a first input node. The second decoder receives a plurality of negative gradation voltages each of which has an electric potential in a range from the third electric potential to the second electric potential, and selects a negative gradation voltage corresponding to another one of the pair of pixel data pieces among the plurality of negative gradation voltages to output the negative gradation voltage to a second input node. The polarity changeover switch circuit performs a polarity switching process that switches between a state in which the electric potential of the first input node is supplied to a first output node and the electric potential of the second input node is supplied to a second output node and a state in which the electric potential of the first input node is supplied to the second output node and the electric potential of the second input node is supplied to the first output node. The precharge circuit precharges the first and second output nodes with the third electric potential immediately before the polarity switching process at each of the polarity switching process by the polarity changeover switch circuit. The first and second amplifiers generate the pair of drive signals by individually amplifying the respective electric potentials of the first and second output nodes.

A semiconductor apparatus according to the present invention is a semiconductor apparatus in which a display driver is formed. The display driver drives a display device in accordance with a plurality of pixel data pieces indicating respective luminance levels of respective pixels based on an image signal. the display driver includes a plurality of driving blocks each of which receives a pair of pixel data pieces among the plurality of pixel data pieces, and generates a pair of drive signals having respective electric potentials corresponding to luminance levels indicated by the pair of pixel data pieces to output the pair of drive signals to the display device. each of the driving blocks includes a first decoder, a second decoder, a polarity changeover switch circuit, a precharge circuit, and first and second amplifiers. The first decoder receives a plurality of positive gradation voltages each of which has an electric potential in a range from a third electric potential between first and second electric potentials that are mutually different to the first electric potential, and selects a positive gradation voltage corresponding to one of the pair of pixel data pieces among the plurality of positive gradation voltages to output the positive gradation voltage to a first input node. The second decoder receives a plurality of negative gradation voltages each of which has an electric potential in a range from the third electric potential to the second electric potential, and selects a negative gradation voltage corresponding to another one of the pair of pixel data pieces among the plurality of negative gradation voltages to output the negative gradation voltage to a second input node. The polarity changeover switch circuit performs a polarity switching process that switches between a state in which the electric potential of the first input node is supplied to a first output node and the electric potential of the second input node is supplied to a second output node and a state in which the electric potential of the first input node is supplied to the second output node and the electric potential of the second input node is supplied to the first output node. The precharge circuit precharges the first and second output nodes with the third electric potential immediately before the polarity switching process at each of the polarity switching process by the polarity changeover switch circuit. The first and second amplifiers generate the pair of drive signals by individually amplifying the respective electric potentials of the first and second output nodes.

In the display driver according to the present invention, the output node of the polarity changeover switch circuit that switches the polarity of the drive signal supplied to the display device from the electric potential of a positive polarity (the first electric potential to the third electric potential between the first electric potential and the second electric potential) to the electric potential of a negative polarity (the third electric potential to the second electric potential) or vice versa is precharged to an intermediate electric potential immediately before the polarity switching. In view of this, it is avoided that the voltage exceeding the withstand voltage (the third electric potential) of the transistors configuring this decoder is applied to the decoder coupled to the input node of this polarity changeover switch circuit via the output node and the polarity changeover switch circuit.

Accordingly, even though the withstand voltage is regulated to the above-described intermediate electric potential in order to downsize a size of the transistors that configure the decoder, the voltage that exceeds the withstand voltage is not applied to this transistor when the polarities are switched.

Therefore, with the present invention, the reduced circuit size can be achieved without causing the reduced product service life caused by a withstand voltage violation of the transistor.

DETAILED DESCRIPTION

The following describes embodiments of the present invention in detail with reference to the drawings.

Figure 1:
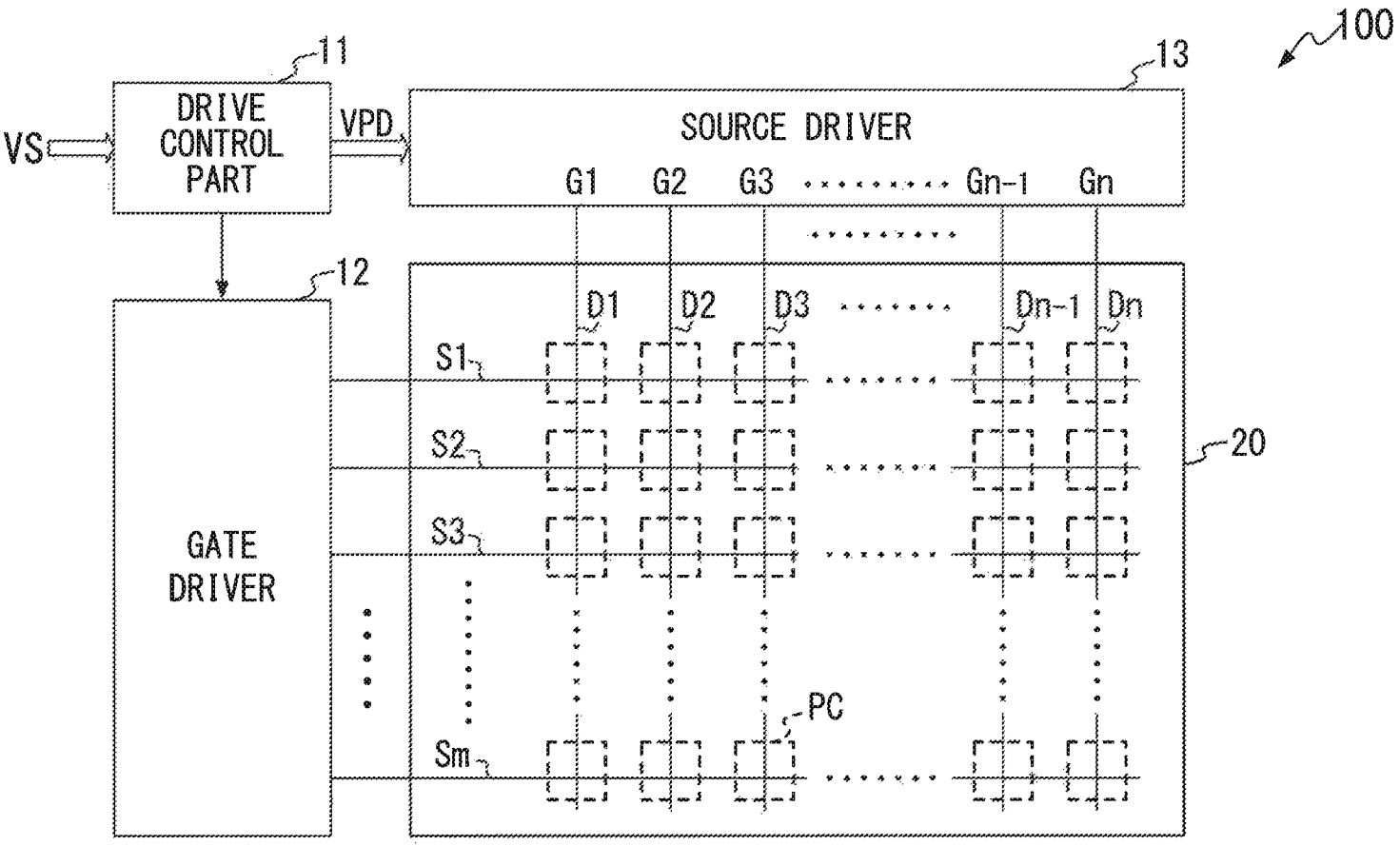
FIG. 1 is a block diagram illustrating a configuration of a display device including a display driver according to the present invention.

FIG. 1 is a block diagram illustrating a configuration of a display apparatus 100 including a display driver according to the present invention. As illustrated in FIG. 1, the display apparatus 100 includes a drive control part 11, a gate driver 12, a source driver 13, and a display device 20 formed of, for example, a liquid crystal display panel.

The display device 20 includes m pieces (m is an integer equal to or more than two) of horizontal scanning lines S1 to Sm that each extend in a horizontal direction of a two-dimensional screen and n pieces (n is an integer equal to or more than two) of source lines D1 to Dn that each extend in a perpendicular direction of the two-dimensional screen. Furthermore, a region of each intersection between the horizontal scanning lines S and the source lines D (regions surrounded by dashed lines) includes a display cell PC that serves as a pixel.

The drive control part 11 generates a series of pixel data PD that represents a luminance level of a pixel for each pixel in, for example, 8 bits and a horizontal synchronization signal based on an input image signal VS. The drive control part 11 supplies the horizontal synchronization signal to the gate driver 12 and generates a video data signal VPD including clock information corresponding to the series of pixel data PD and the horizontal synchronization signal described above to supply this to the source driver 13.

The gate driver 12 generates a gate pulse in synchronization with the horizontal synchronization signal supplied from the drive control part 11, and applies this to each of the horizontal scanning lines S1 to Sm of the display device 20 in order.

The source driver 13 generates pixel drive signals G1 to Gn that correspond to the respective source lines D1 to Dn of the display device 20 on the basis of the video data signal VPD and individually outputs to the corresponding source lines D1 to Dn. The source driver 13 is formed of a single semiconductor chip or a plurality of divided semiconductor chips.

Figure 2:
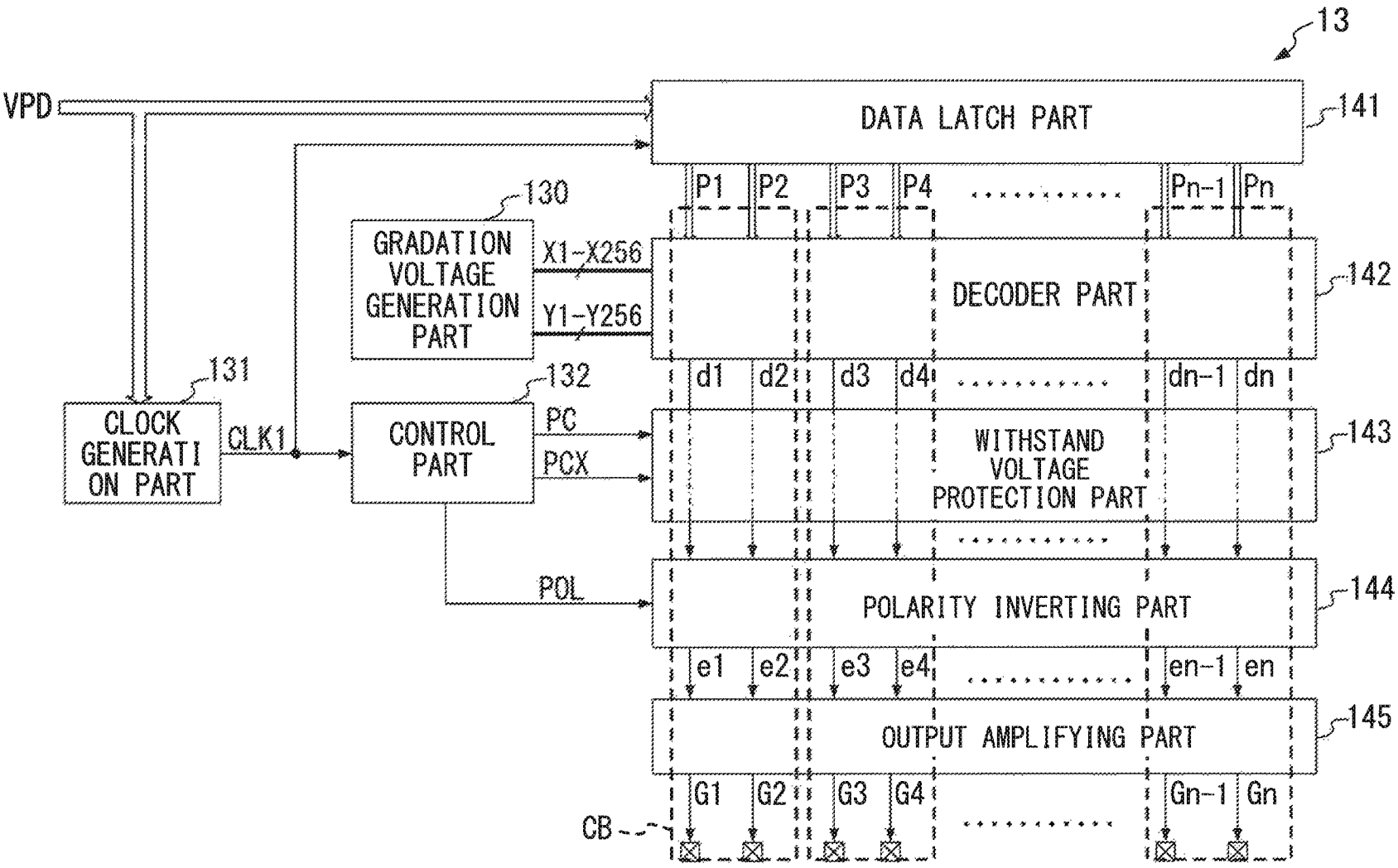
FIG. 2 is a block diagram illustrating an internal configuration of a source driver.

FIG. 2 is a block diagram illustrating an internal configuration of the source driver 13.

As illustrated in FIG. 2, the source driver 13 includes a gradation voltage generation part 130, a clock generation part 131, a control part 132, a data latch part 141, a decoder part 142, a withstand voltage protection part 143, a polarity inverting part 144, and an output amplifying part 145.

The gradation voltage generation part 130 generates positive gradation voltages X1 to X256 as 256 voltages of positive polarity that represent luminance levels displayed on the display device 20 by, for example, 256 gradations, and generates negative gradation voltages Y1 to Y256 as 256 voltages of negative polarity.

Figure 3:
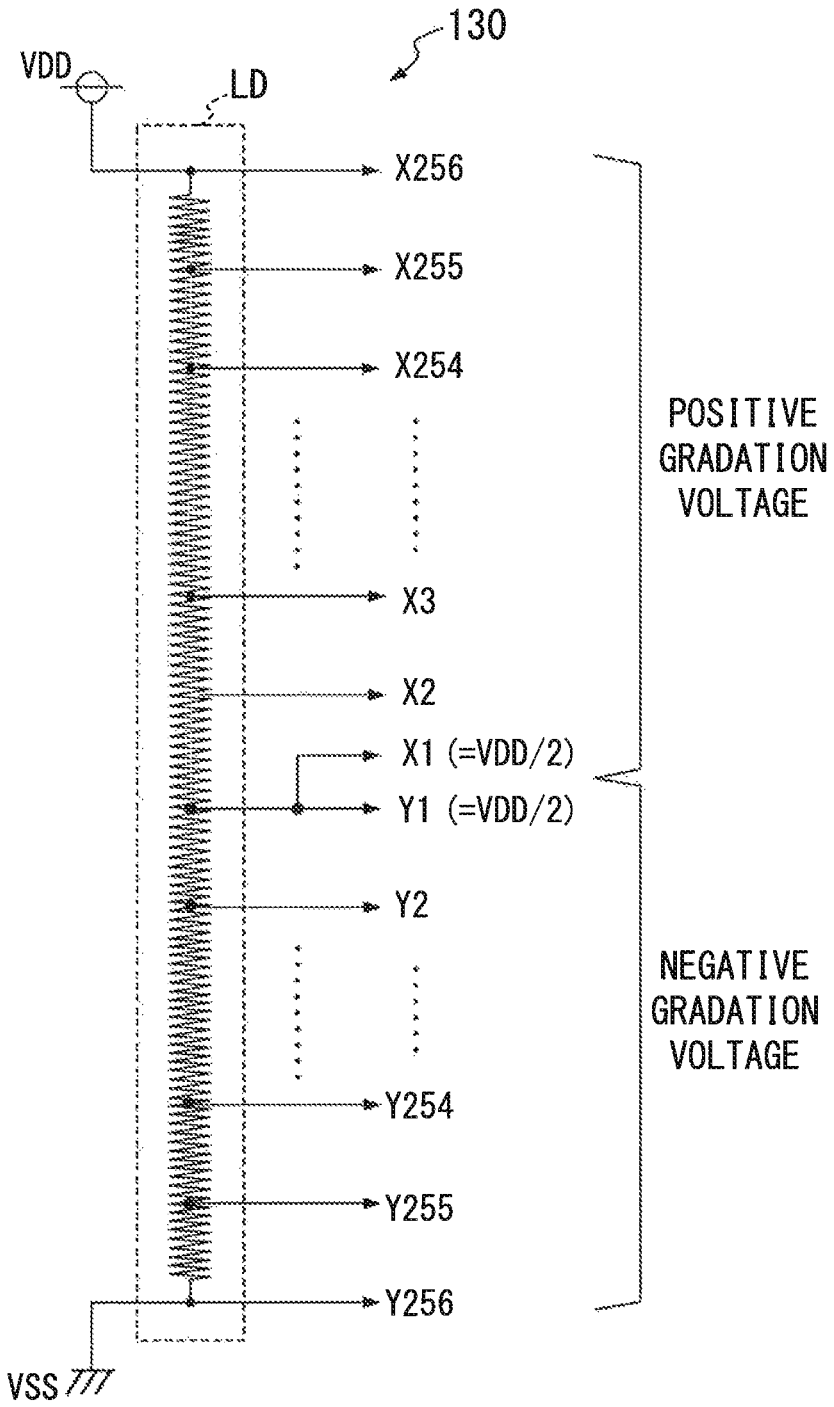
FIG. 3 is a circuit diagram representing an exemplary circuit in a final stage in a gradation voltage generation part.

FIG. 3 is a circuit diagram that illustrates an exemplary circuit at a final stage in the gradation voltage generation part 130.

As illustrated in FIG. 3, the gradation voltage generation part 130 includes a ladder resistor LD.

The ladder resistor LD receives a power supply potential VDD that becomes an electric potential of X256 corresponding to the maximum luminance level among the positive gradation voltages X1 to X256 and a ground potential VSS (=0 volts) that becomes an electric potential of Y256 corresponding to the minimum luminance level among the negative gradation voltages Y1 to Y256.

The ladder resistor LD divides the voltage between the power supply potential VDD and the ground potential VSS (=0 volts) by resistors into voltages. Among the plurality of electric potentials divided, electric potentials equal to or more than VDD/2 are gradation voltages of positive polarity and electric potentials equal to or less than VDD/2 are gradation voltages of negative polarity. That is, among the plurality of electric potentials divided by the ladder resistor LD, 256 electric potentials equal to or more than VDD/2 are positive gradation voltages X1 to X256, and 256 voltages equal to or less than VDD/2 are negative gradation voltages Y1 to Y256. In this respect, the minimum positive gradation voltage X1 among the positive gradation voltages X1 to X256 and the maximum negative gradation voltage Y1 among the negative gradation voltages Y1 to Y256 both have VDD/2.

The gradation voltage generation part 130 supplies the positive gradation voltages X1 to X256 and the negative gradation voltages Y1 to Y256, which are described above, generated by the ladder resistor LD to the decoder part 142.

The clock generation part 131 generates a clock signal CLK1 in which one pulse appears at each predetermined interval on the basis of a clock information included in the video data signal VPD, and this is supplied to the data latch part 141 and the control part 132.

The control part 132 generates a binary (a logical level 1 or 0) polarity inversion signal POL that inverts polarities of respective pixel drive signals G1 to Gn in response to the clock signal CLK1, and supplies this to the polarity inverting part 144. Furthermore, the control part 132 generates a binary precharge signal PC in response to the clock signal CLK1 and an inverted precharge signal PCX that is the precharge signal PC whose phase is inverted, and each of them is supplied to the withstand voltage protection part 143.

Figure 4:
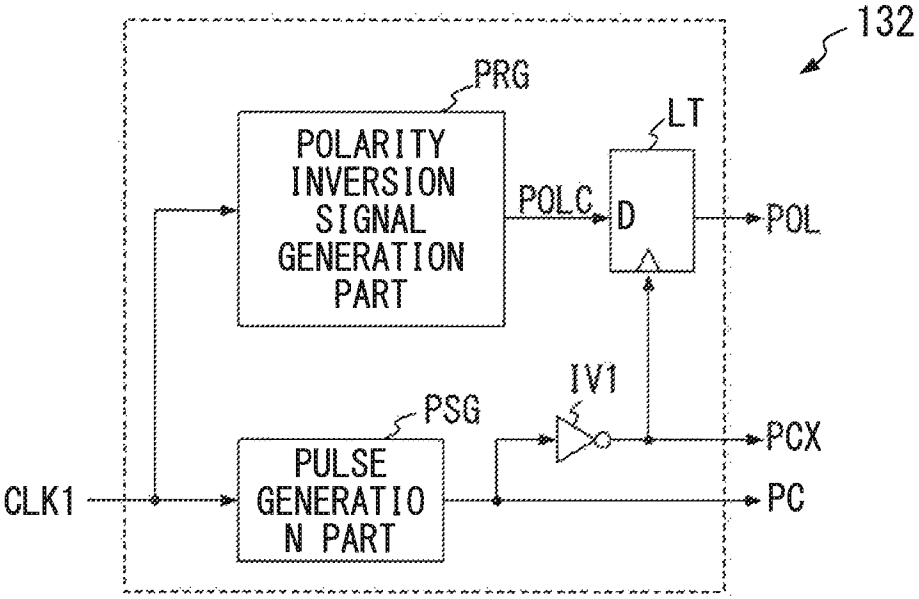
FIG. 4 is a block diagram illustrating an exemplary internal configuration of a control part.
Figure 5:
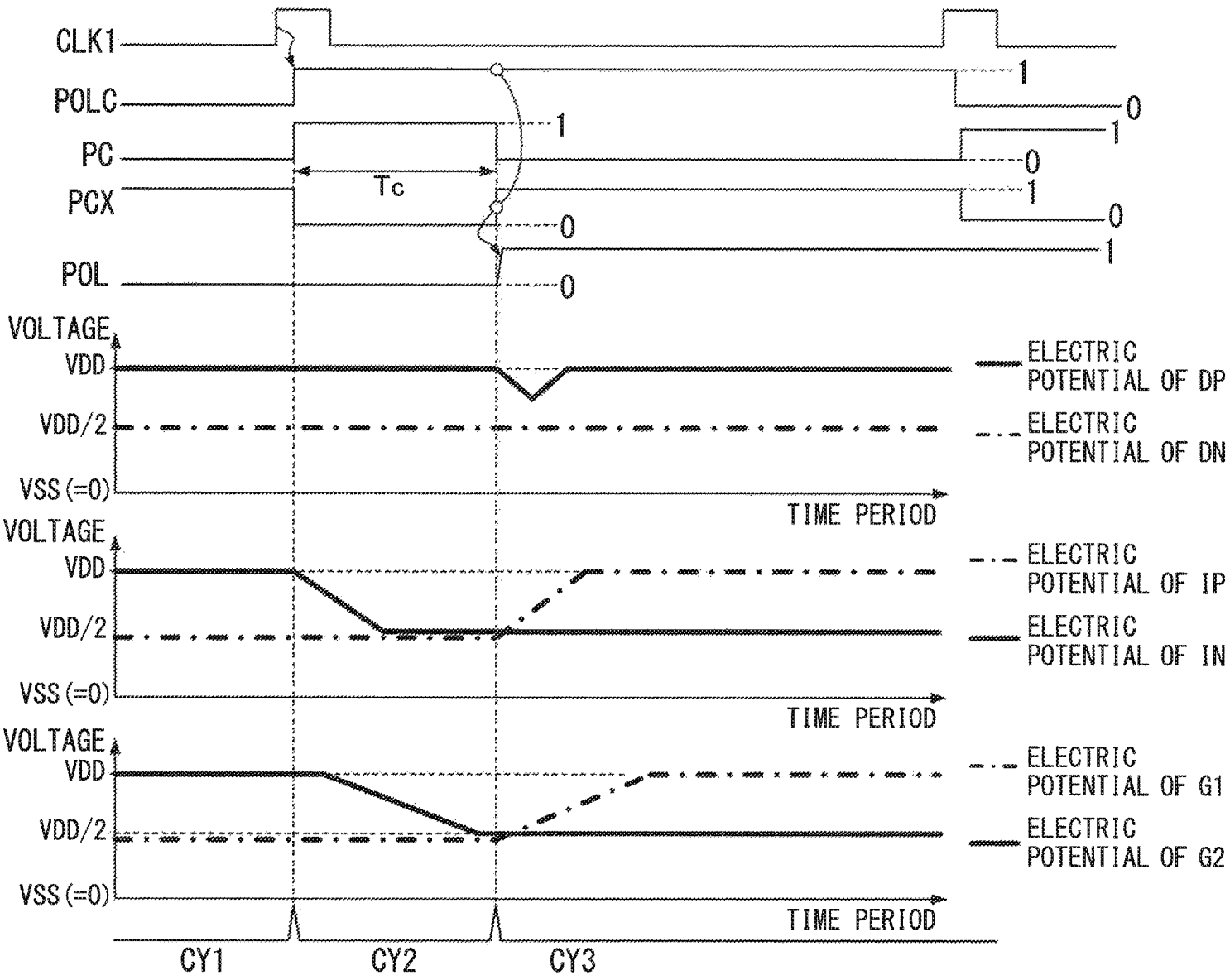
FIG. 5 is a timing chart representing one example of various kinds of signals generated in the control part, an electric potential waveform inside a polarity inverting part, and a waveform of a pixel drive signal.

FIG. 4 is a block diagram illustrating an exemplary internal configuration of the control part 132. FIG. 5 is a timing chart illustrating one example of the following signals of various kinds generated in the control part 132, an electric potential waveform inside the polarity inverting part 144, and a waveform of a pixel drive signal G.

As illustrated in FIG. 4, the control part 132 includes a pulse generation part PSG, an inverter IV1, a polarity inversion signal generation part PRG, and a latch LT.

The pulse generation part PSG generates a binary (the logical level 1 or 0) signal in which a single pulse (for example, the logical level 1) having a predetermined pulse width Tc appears as the precharge signal PC, as illustrated in FIG. 5, in response to the clock signal CLK1. The inverter IV1 generates a signal that is the precharge signal PC whose logical level is inverted as the inverted precharge signal PCX. Note that, the precharge signal PC generated by the pulse generation part PSG has an amplitude shifted in a direction in which an amplitude of the clock signal CLK1 increases.

The polarity inversion signal generation part PRG, as illustrated in FIG. 5, generates a binary signal whose logical level is inverted at a timing of, for example, a rising edge of the clock signal CLK1 as a basic polarity inversion signal POLC, and supplies this to the latch LT. The latch LT, as illustrated in FIG. 5, latches the basic polarity inversion signal POLC at a timing of a rising edge of the inverted precharge signal PCX, and outputs this as the above-described polarity inversion signal POL while holding this. The amplitude of the polarity inversion signal POL generated by the latch LT is one shifted in a direction in which an amplitude of the basic polarity inversion signal POLC increases.

The data latch part 141 sequentially latches a series of pixel data PD included in the video data signal VPD. Each time when n number of the pixel data PD of one horizontal scanning line are latched, the data latch part 141 supplies the n number of pixel data PD to the decoder part 142 as pixel data P1 to Pn at a timing synchronized with the clock signal CLK1.

The decoder part 142, for example, selects at least one gradation voltage corresponding to a luminance level indicated by the pixel data P from the positive gradation voltages X1 to X256 for each piece of odd numbered pixel data P1, P3, P5, P7 . . . among the pixel data P1 to Pn. The decoder part 142 selects at least one gradation voltage corresponding to a luminance level indicated by the pixel data P from the negative gradation voltages Y1 to Y256 for each piece of even numbered pixel data P2, P4, P6, P8 . . . . The decoder part 142 supplies the gradation voltages selected for each piece of pixel data P1 to Pn to the withstand voltage protection part 143 as each of the gradation voltages d1 to dn.

The withstand voltage protection part 143 precharges a node on each line that transmits the gradation voltages d1 to dn to the polarity inverting part 144 in the next stage with VDD/2 only during the pulse width Tc illustrated in FIG. 5, in response to the precharge signal PC and the inverted precharge signal PCX.

The polarity inverting part 144 obtains gradation voltages d1 to dn switched between odd numbered gradation voltages and even numbered gradation voltages adjacent to one another as gradation voltages e1 to en at, for example, each timing of rising edge of the polarity inversion signal POL. For example, the polarity inverting part 144 outputs the odd numbered gradation voltages d1, d3, d5, and d7 as the even numbered gradation voltages e2, e4, e6, and e8, and outputs the even numbered gradation voltages d2, d4, d6, and d8 as the odd numbered gradation voltages e1, e3, e5, and e7.

That is, the polarity inverting part 144 performs a polarity switching process that switches each of the gradation voltages e1 to en from the positive polarities (VDD to VDD/2) to the negative polarities (VDD/2 to VSS) or the negative polarities to the positive polarities at, for example, each timing of rising edge of the polarity inversion signal POL.

The polarity inverting part 144 supplies the gradation voltages e1 to en obtained by the above-described polarity switching process to the output amplifying part 145.

The output amplifying part 145 outputs signals obtained by individually amplifying the respective gradation voltages e1 to en as the pixel drive signals G1 to Gn to the source lines S1 to Sn of the display device 20 via respective external terminals of the semiconductor chip.

The decoder part 142, the withstand voltage protection part 143, the polarity inverting part 144, and the output amplifying part 145 described above each individually receive the pixel data P1 to Pn, and are divided into n channels that generate the respective pixel drive signals G1 to Gn having voltages corresponding to luminance levels indicated by the respective pixel data P. In the decoder part 142, the withstand voltage protection part 143, the polarity inverting part 144, and the output amplifying part 145, as illustrated in FIG. 2, each of the driving blocks CB (the regions surrounded by the dashed line) in charge of an operation of a pair of channels for each pair of the channels adjacent to one another is configured of the same circuit configuration.

The following excerpts the driving block CB corresponding to a pair of channels formed of a first channel that receives the pixel data P1 and a second channel that receives the pixel data P2 and describes its internal configuration in details.

Figure 6:
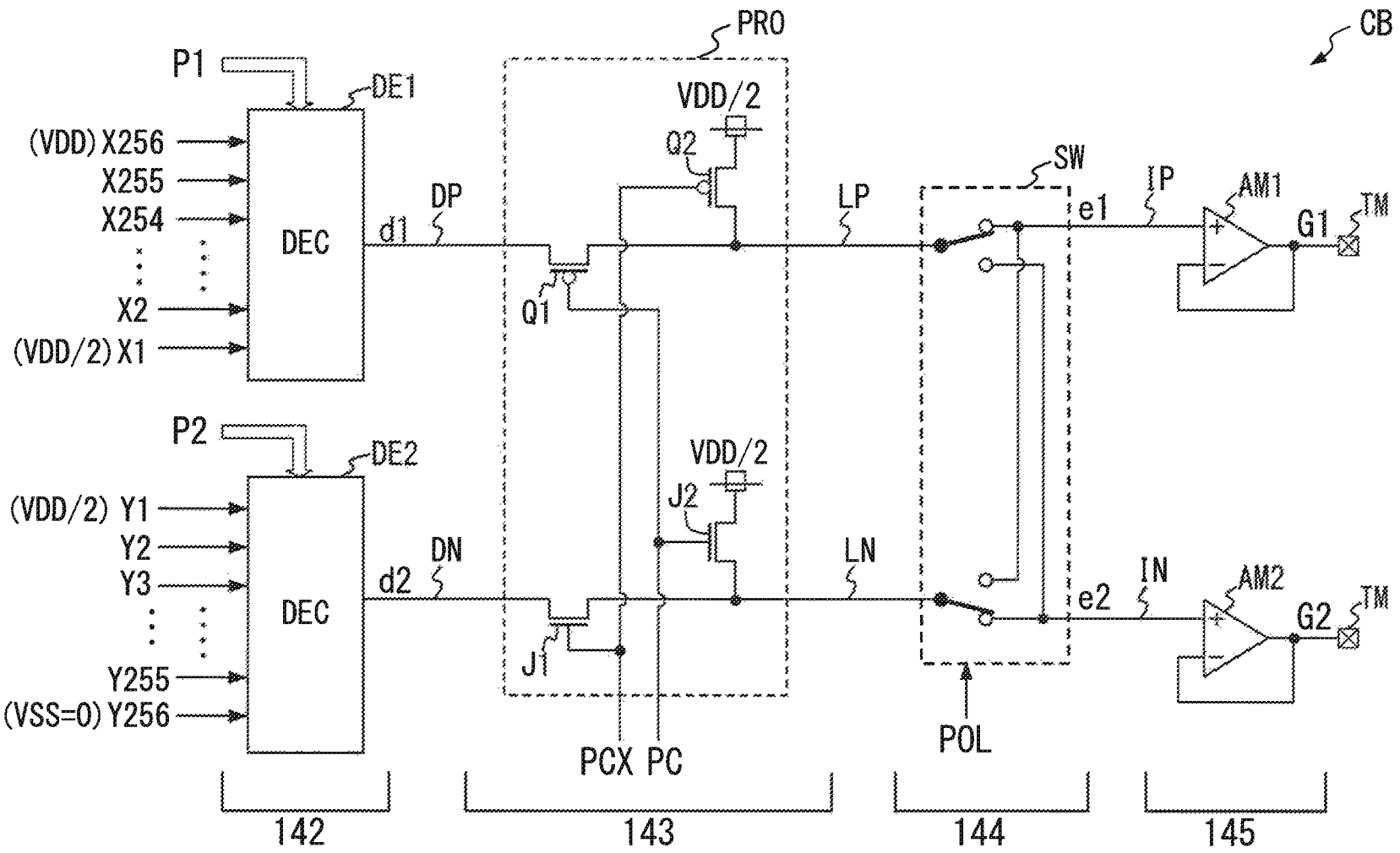
FIG. 6 is a circuit diagram illustrating an exemplary internal circuit of each of a decoder part, the polarity inverting part, a withstand voltage protection part, and an output amplifying part in a driving block.

FIG. 6 is a circuit diagram that illustrates an exemplary internal circuit of each of the decoder part 142, the withstand voltage protection part 143, the polarity inverting part 144, and the output amplifying part 145 in such a driving block CB.

As illustrated in FIG. 6, in the driving block CB, the decoder part 142 includes a first decoder DE1 and a second decoder DE2, and the withstand voltage protection part 143 includes a precharge circuit PRO. Furthermore, in the driving block CB, the polarity inverting part 144 includes a polarity changeover switch circuit SW, and the output amplifying part 145 includes operational amplifiers AM1 and AM2 of a voltage follower.

The decoder DE1 receives the positive gradation voltages X1 to X256 and selects one that corresponds to the luminance level indicated by the pixel data P1 among these positive gradation voltages X1 to X256, and supplies this to the withstand voltage protection part 143 via an input node DP as the gradation voltage d1.

The decoder DE2 receives the negative gradation voltages Y1 to Y256 and selects one that corresponds to the luminance level indicated by the pixel data P2 among these negative gradation voltages Y1 to Y256, and supplies this to the withstand voltage protection part 143 via an input node DN as the gradation voltages d2.

Figure 7:
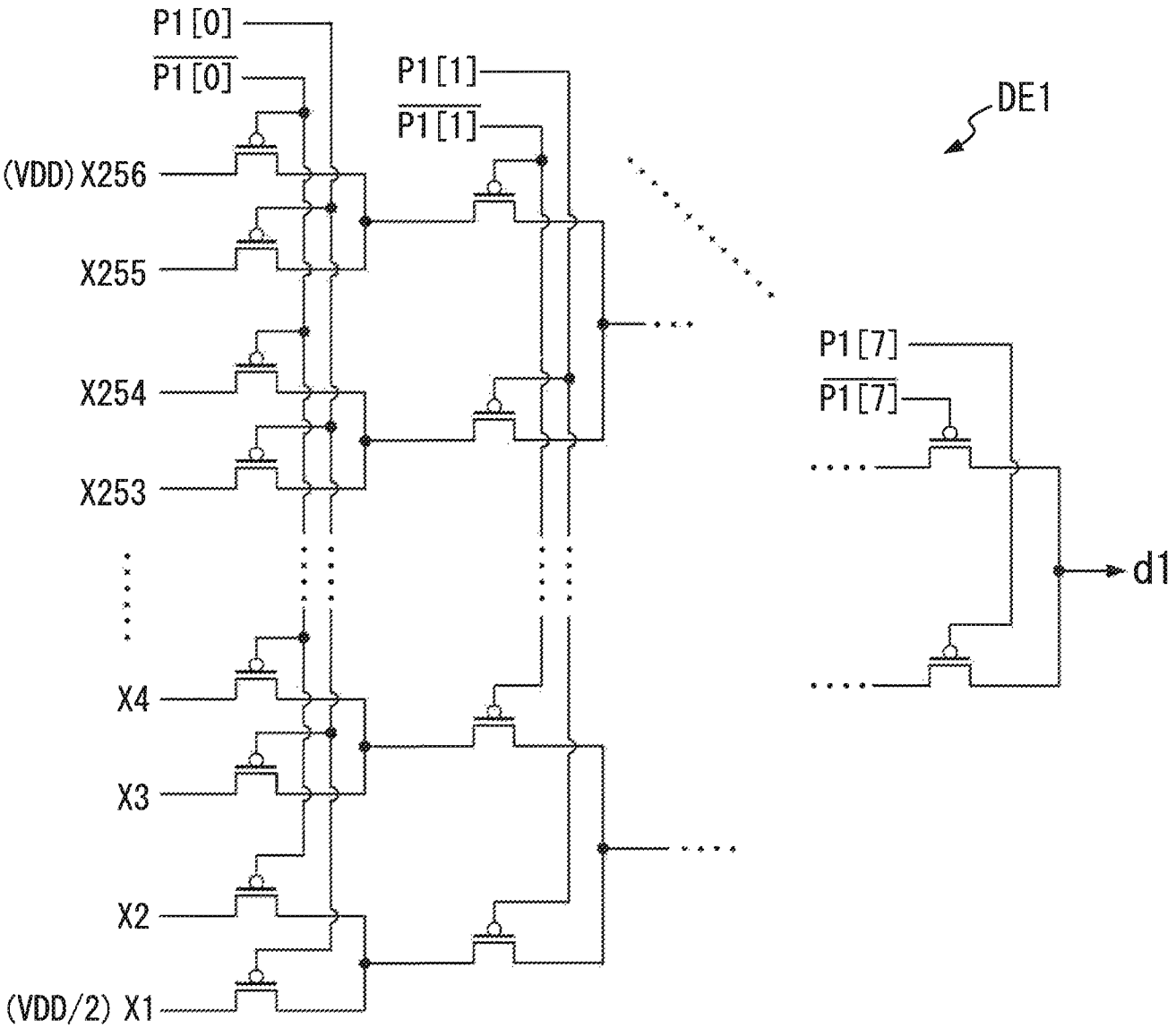
FIG. 7 is a circuit diagram illustrating an exemplary internal configuration of a first decoder.

FIG. 7 is a circuit diagram illustrating an exemplary internal configuration of the decoder DE1 when the pixel data P1 is 8 bit data [0:7]. As illustrated in FIG. 7, the decoder DE1 has a configuration in which a plurality of p channel MOS transistors coupled in cascade by the number of stages corresponding to the number of bits of the pixel data P1 in a tournament method. The plurality of p channel MOS transistors include p channel MOS transistors that individually receive the respective positive gradation voltages X1 to X256.

Figure 8:
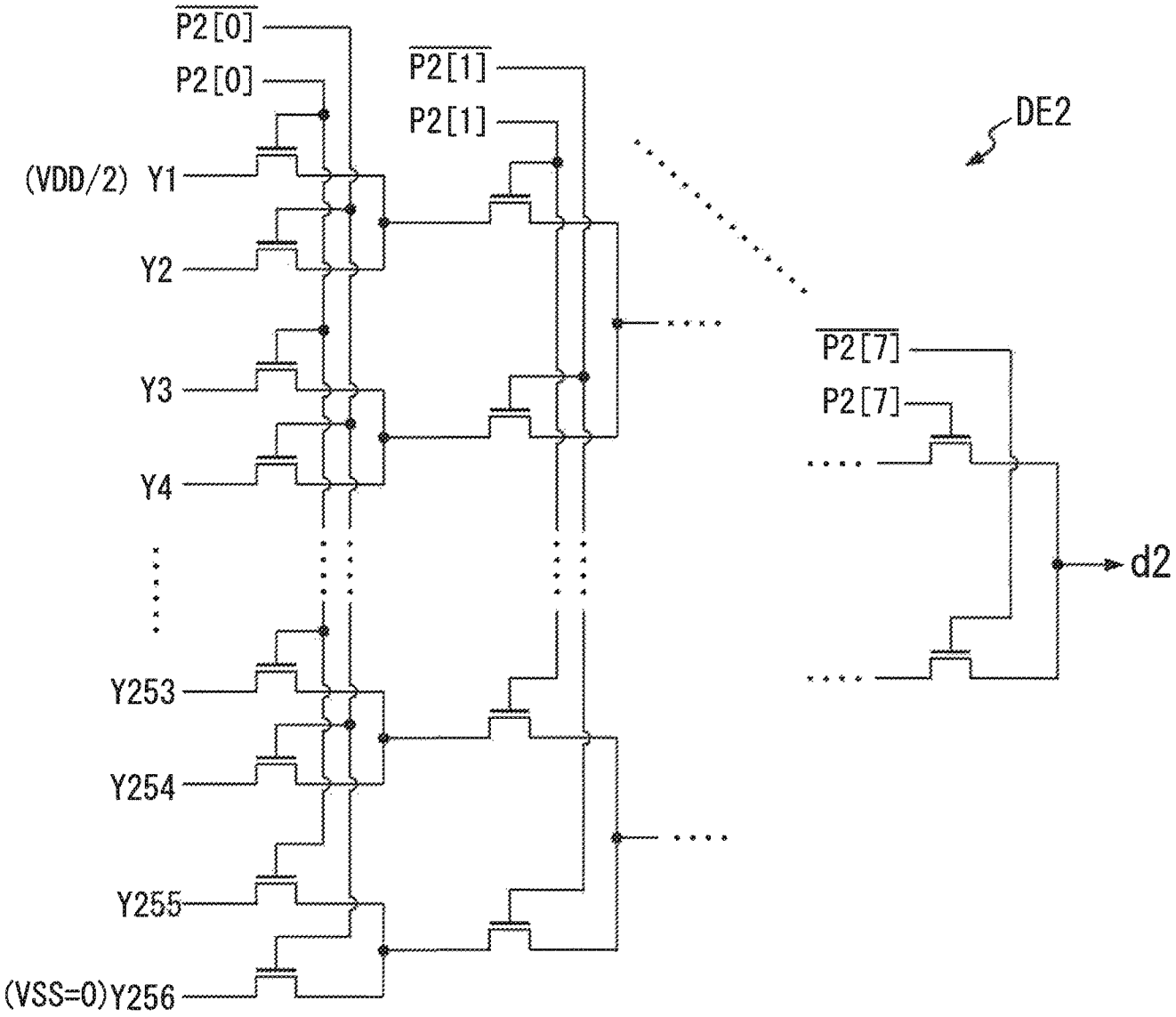
FIG. 8 is a circuit diagram illustrating an exemplary internal configuration of a second decoder.

FIG. 8 is a circuit diagram illustrating an exemplary internal configuration of the decoder DE2 with the pixel data P2 as 8 bit data [0:7]. As illustrated in FIG. 8, the decoder DE2 has a configuration in which a plurality of n channel MOS transistors coupled in cascade by the number of stages corresponding to the number of bits of the pixel data P2 in a tournament method. The plurality of n channel MOS transistors include n channel MOS transistors that individually receive the respective negative gradation voltages Y1 to Y256.

The minimum positive gradation voltage X1 is VDD/2 and the maximum positive gradation voltages X256 is the power supply potential VDD among the positive gradation voltages X1 to X256 received by the decoder DE1. Accordingly, the maximum voltage that is applied to the decoder DE1 is (VDD−VDD/2), that is, VDD/2. On the other hand, the minimum negative gradation voltage Y256 is the ground potential VSS (0 volts) and the maximum negative gradation voltage Y1 is VDD/2 among the negative gradation voltages Y1 to Y256 received by the decoder DE2. Accordingly, the maximum voltage applied to the decoder DE2 is also VDD/2.

Therefore, considering a downsized circuit size, a limit voltage between the drain and the source of each of the p channel MOS transistors configuring the decoder DE1 and each of the n channel MOS transistors configuring the decoder DE2, that is, a withstand voltage is regulated to VDD/2.

The precharge circuit PRO includes p channel MOS type transistors Q1 and Q2 and n channel MOS type transistors J1 and J2. The transistor Q1 is a switch element that couples or cuts off between a relay node LP coupled to the polarity changeover switch circuit SW and the input node DP. The transistor J1 is a switch element that couples or cuts off between a relay node LN coupled to the polarity changeover switch circuit SW and the input node DN. The transistors Q2 and J2 are transistors for precharging that precharge by applying VDD/2 to each of the relay nodes LP and LN.

A source of the transistor Q1 is coupled to the input node DP and its drain is coupled to the relay node LP. The transistor Q1 receives the precharge signal PC at its own gate, and is turned into an ON state when the precharge signal PC has the logical level 0 and is turned into an OFF state when the precharge signal PC has the logical level 1. The transistor Q1 couples the input node DP to the relay node LP only when it is in the ON state, thereby supplying the gradation voltage d1 received via the input node DP to the polarity changeover switch circuit SW via the relay node LP.

VDD/2 is applied to a source of the transistor Q2, and a drain is coupled to the relay node LP. The transistor Q2 receives the inverted precharge signal PCX at its own gate, and is turned into the ON state when the inverted precharge signal PCX has the logical level 0 and is turned into the OFF state when the inverted precharge signal PCX has the logical level 1. The transistor Q2 applies VDD/2 to the relay node LP only when it is in the ON state, thereby precharging the relay node LP with VDD/2.

A drain of the transistor J1 is coupled to the input node DN, and its source is coupled to the relay node LN. The transistor J1 receives the inverted precharge signal PCX at its own gate, and is turned into the ON state when the inverted precharge signal PCX has the logical level 1 and is turned into the OFF state when the inverted precharge signal PCX has the logical level 0. The transistor J1 couples the input node DN to the relay node LN only when in the ON state, thereby supplying the gradation voltage d2 received via the input node DN to the polarity changeover switch circuit SW via the relay node LN.

VDD/2 is applied to a source of the transistor J2, and a drain is coupled to the relay node LN. The transistor J2 receives the precharge signal PC at its own gate, and is turned into the ON state when the precharge signal PC has the logical level 1 and is turned into the OFF state when the precharge signal PC has the logical level 0. The transistor J2 applies VDD/2 to the relay node LN only when it is in the ON state, thereby precharging the relay node LN with VDD/2.

The polarity changeover switch circuit SW illustrated in FIG. 6 is coupled to the above-described relay nodes LP and LN, which are as nodes in an input side, and to the output nodes IP and IN, which are as nodes in an output side.

The polarity changeover switch circuit SW receives the polarity inversion signal POL, and while the polarity inversion signal POL has, for example, the logical level 0, electrically couples the relay node LP to the output node IP and electrically couples the relay node LN and the output node IN. That is, during this, the polarity changeover switch circuit SW supplies the gradation voltages d1 output from the decoder DE1 to a non-inverting input terminal of the operational amplifier AM1 via the output node IP as the gradation voltages e1. Furthermore, during this, the polarity changeover switch circuit SW supplies the gradation voltages d2 output from the decoder DE2 to a non-inverting input terminal of the operational amplifier AM2 via the output node IN as the gradation voltages e2.

While the polarity inversion signal POL has, for example, the logical level 1, the polarity changeover switch circuit SW electrically couples the relay node LP to the output node IN and electrically couples the relay node LN to the output node IP. That is, during this, the polarity changeover switch circuit SW supplies the gradation voltages d1 output from the decoder DE1 to a non-inverting input terminal of the operational amplifier AM2 via the output node IN as the gradation voltages e2. Furthermore, during this, the polarity changeover switch circuit SW supplies the gradation voltages d2 output from the decoder DE2 to a non-inverting input terminal of the operational amplifier AM1 via the output node IP as the gradation voltages e1.

The operational amplifier AM1 is, what is called, a voltage follower, in which its own output terminal is coupled to the inverting input terminal, and outputs a signal obtained by amplifying the gradation voltages e1 received by its own non-inverting input terminal via the output node IP at unity gain from an external terminal TM as the pixel drive signal G1. The operational amplifier AM2 is, what is called, a voltage follower, in which its own output terminal is coupled to the inverting input terminal, and outputs a signal obtained by amplifying the gradation voltages e2 received by its own non-inverting input terminal via the output node IN at unity gain from the external terminal TM as the pixel drive signal G2.

The following describes a withstand voltage protection operation by the withstand voltage protection part 143 including the above-described precharge circuit PRO.

First, a description will be made for a problem that would be caused when the withstand voltage protection part 143 was not provided. When the withstand voltage protection part 143 is not provided, in the control part 132 illustrated in FIG. 4, the pulse generation part PSG, the inverter IV1, or the latch LT are not included either. Accordingly, the basic polarity inversion signal POLC generated by the polarity inversion signal generation part PRG is directly supplied to the polarity inverting part 144 as the polarity inversion signal POL.

Figure 9A:
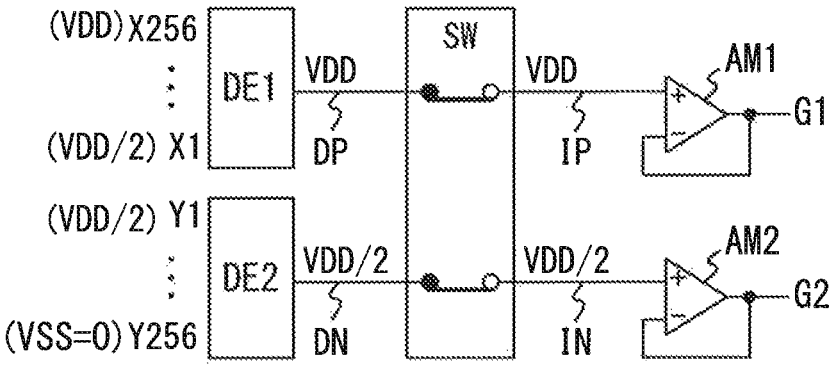
FIG. 9A is a drawing illustrating an exemplary electric potential state of each node before polarity switching in a configuration that omits the withstand voltage protection part from the driving block.
Figure 9B:
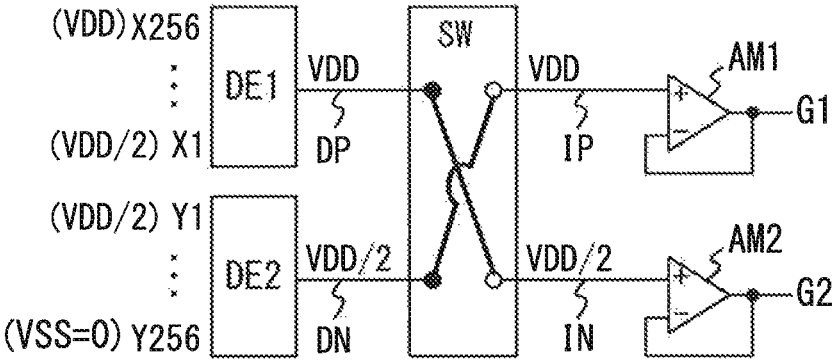
FIG. 9B is a drawing illustrating an exemplary electric potential state of each node immediately after the polarity switching in the configuration that omits the withstand voltage protection part from the driving block.

FIG. 9A and FIG. 9B are drawings that illustrate states of electric potentials of the respective nodes in the driving block CB before and after polarity switching in the configuration where the withstand voltage protection part 143 (the precharge circuit PRO) is omitted from the driving block CB illustrated in FIG. 6. FIG. 9A illustrates a state immediately before the polarity switching, and FIG. 9B illustrates a state immediately after the polarity switching.

In FIG. 9A, the decoder DE1 outputs VDD as an electric potential of the maximum electric potential handled by itself, that is, the positive gradation voltage X256 to the input node DP, and the decoder DE2 outputs VDD/2 as an electric potential of the maximum electric potential handled by itself, that is, the negative gradation voltage Y1 to the input node DN. The polarity changeover switch circuit SW couples the input node DP to the output node IP and couples the input node DN to the output node IN, as illustrated in FIG. 9A. In view of this, as illustrated in FIG. 9A, the output node IP is turned into a VDD state and the output node IN is turned into a VDD/2 state.

Afterwards, the polarity changeover switch circuit SW, as illustrated in FIG. 9B, performs the polarity switching that switches the state to a state where the input node DP is coupled to the output node IN, and the input node DN is coupled to the output node IP. Note that, even immediately after this polarity switching, the electric potential of the output node IP is maintained to be VDD by an input capacity of the operational amplifier AM1, and similarly, the electric potential of the output node IN is maintained to be VDD/2 by an input capacity of the operational amplifier AM2.

Accordingly, immediately after the above-described polarity switching by the polarity changeover switch circuit SW, as illustrated in FIG. 9B, VDD as the electric potential of the input node DP is applied to the output node IN in the state of VDD/2, and VDD/2 as the electric potential of the input node DN is applied to the output node IP in the state of VDD.

In this respect, while the electric potential of the input node DP does not exceed VDD as the maximum electric potential handled by the decoder DE1, the electric potential of the input node DN is temporarily increased to more than VDD/2 as the maximum electric potential handled by the decoder DE2 by being coupled to the output node IP.

Accordingly, immediately after the polarity switching by the polarity changeover switch circuit SW, the decoder DE2 is applied with a voltage exceeding the withstand voltage (VDD/2) of the n channel MOS transistors that configure the decoder DE2, thus causing a reduced product service life.

When the polarity switching is performed from the state where the decoder DE1 outputs VDD/2 as the electric potential corresponding to the positive gradation voltage X1 as the minimum electric potential handled by itself to the input node DP, and the decoder DE2 outputs the electric potential VSS (0 volts) of the negative gradation voltage Y256 as the minimum electric potential handled by itself to the input node DN, a withstand voltage violation as described above occurs in a side of the decoder DE1. That is, immediately after the polarity switching by the polarity changeover switch circuit SW, the decoder DE1 is applied with the voltage exceeding the withstand voltage (VDD/2) of the p channel MOS transistors that configure the decoder DE1, thus causing a reduced product service life.

Therefore, the source driver 13 solves the problem as described above with the withstand voltage protection part 143 including the precharge circuit PRO illustrated in FIG. 6.

The following describes the withstand voltage protection operation by the precharge circuit PRO with reference to FIG. 5 and FIG. 10A to FIG. 10C.

Figure 10A:
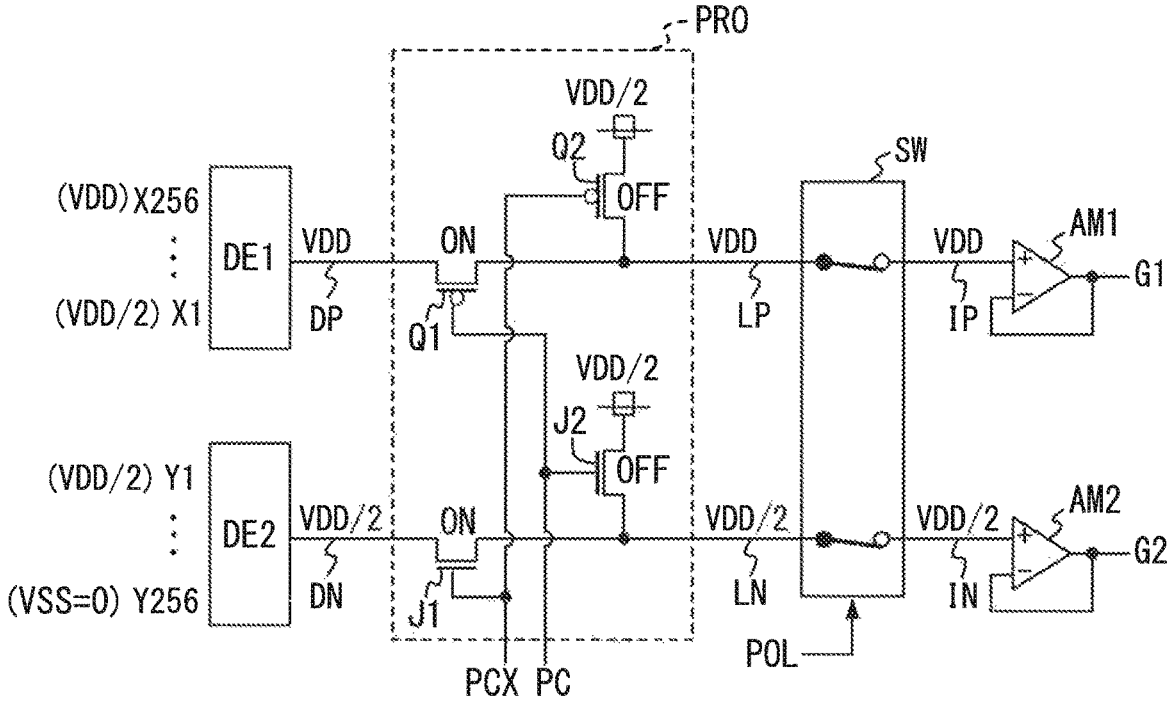
FIG. 10A is a drawing illustrating an exemplary electric potential state of each node before the polarity switching in the driving block.
Figure 10B:
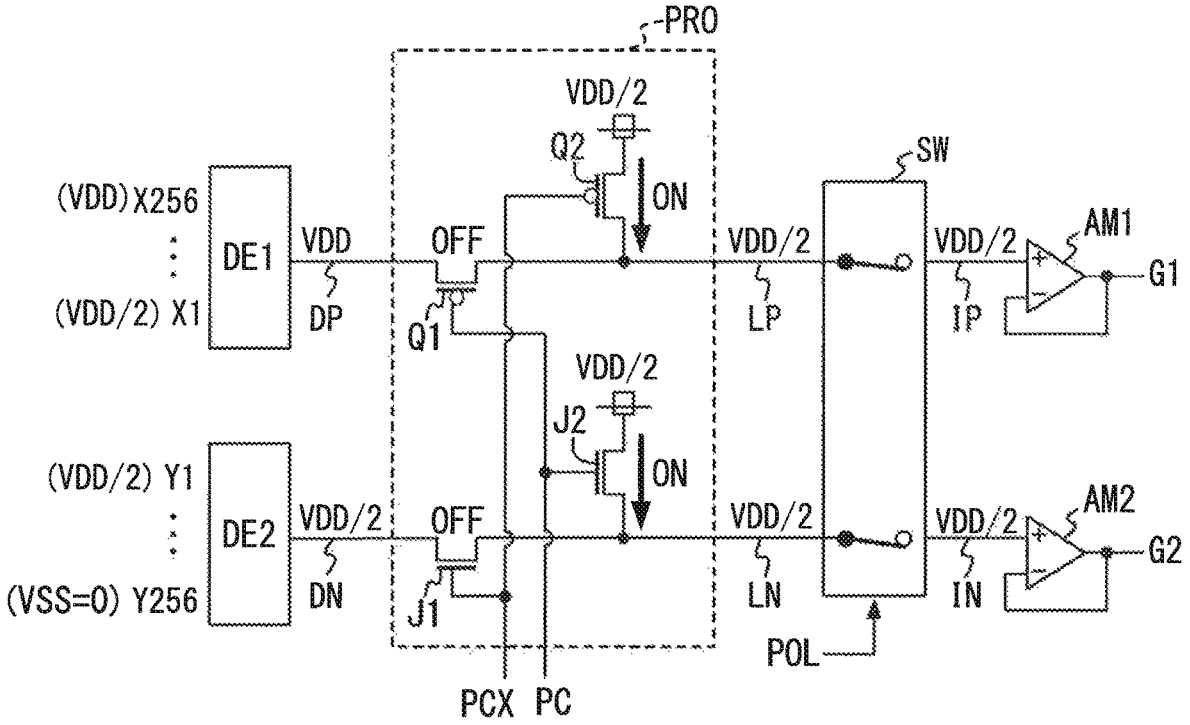
FIG. 10B is a drawing illustrating an exemplary electric potential state of each node when precharging in the driving block.
Figure 10C:
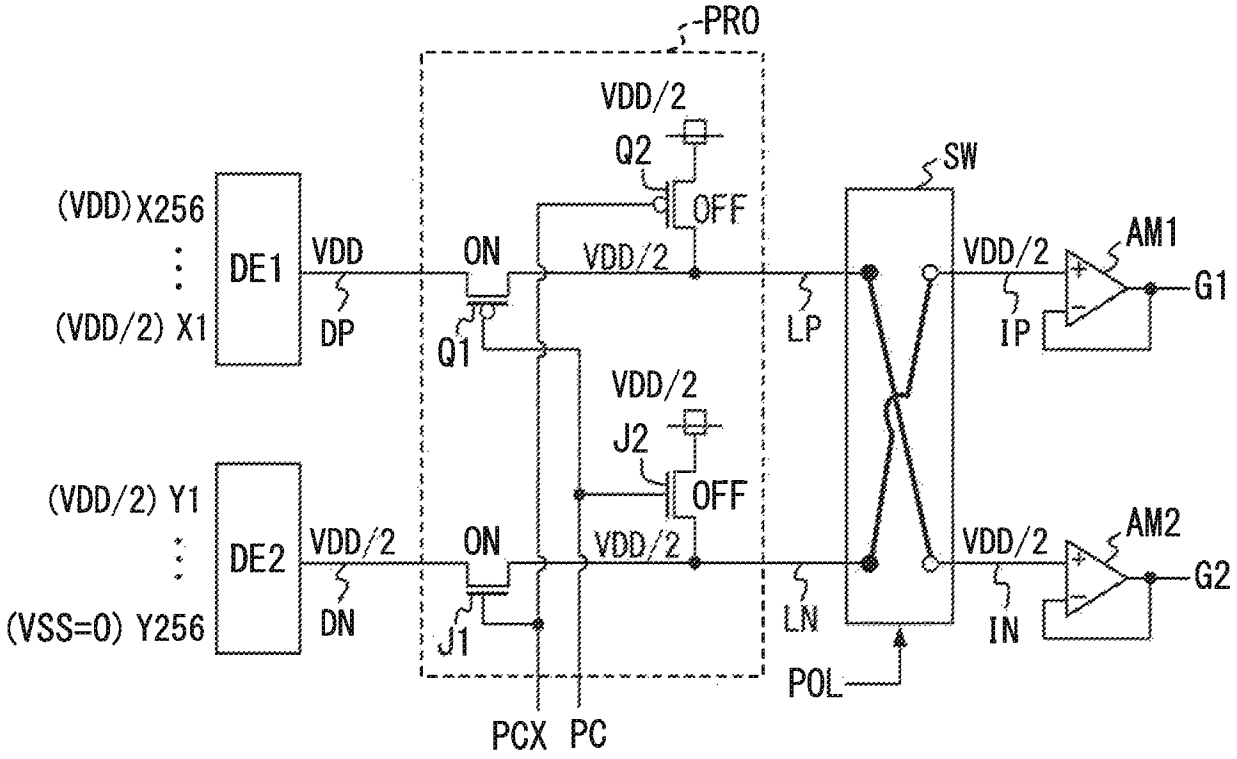
FIG. 10C is a drawing illustrating an exemplary electric potential state of each node immediately after the polarity switching in the driving block.

FIG. 5 illustrates electric potential waveforms of respective nodes (DP, DN, IP, and IN) and outputs (G1 and G2) in the driving block CB illustrated in FIG. 6 corresponding to various kinds of control signals (POL, POLC, PC, and PCX) before and after the polarity switching. FIG. 10A to FIG. 10C are drawings visually illustrating states of the electric potentials of the respective nodes in the driving block CB and operating states in the polarity changeover switch circuit SW and the precharge circuit PRO at each phase before and after the polarity switching.

First, at a phase before the polarity switching (a process CY1) in FIG. 5, as illustrated in FIG. 10A, the decoder DE1 outputs VDD as the electric potential corresponding to the positive gradation voltage X256 as the maximum electric potential handled by itself to the input node DP. Furthermore, the maximum electric potential handled by the decoder DE2 itself, that is, VDD/2 as the electric potential of the negative gradation voltage Y1 is output to the input node DN. In such a process CY1, in response to the polarity inversion signal POL of the logical level 0 illustrated in FIG. 5, the polarity changeover switch circuit SW couples the relay node LP to the output node IP and couples the relay node LN to the output node IN as illustrated in FIG. 10A. Furthermore, in the process CY1, in response to the precharge signal PC of the logical level 0 and the inverted precharge signal PCX of the logical level 1, the transistors Q1 and J1 are turned into the ON state, and the transistors Q2 and J2 for precharging are turned into the OFF state as illustrated in FIG. 10A.

This turns the input node DP and the output node IP into the VDD state in the process CY1 as illustrated in FIG. 5, and the pixel drive signal G1 having this VDD is output. Furthermore, in the process CY1, as illustrated in FIG. 5, the input node DN and the output node IN are turned into the VDD/2 state, and the pixel drive signal G2 having this VDD/2 is output.

Afterwards, as illustrated in FIG. 5, in response to the clock signal CLK1, the basic polarity inversion signal POLC transitions from the logical level 0 to the logical level 1 at the timing of its rising edge. Furthermore, in response to the clock signal CLK1, as illustrated in FIG. 5, the precharge signal PC is turned into a state of the logical level 1 and the inverted precharge signal PCX is turned into a state of the logical level 0 only during the pulse width Tc (a process CY2). In response to these precharge signal PC of the logical level 1 and inverted precharge signal PCX of the logical level 0, the transistors Q1 and J1 are transitioned to the OFF state and the transistors Q2 and J2 for precharging are turned into the ON state as illustrated in FIG. 10B. During such a process CY2, the polarity inversion signal POL is maintained to be in the logical level 0 state as illustrated in FIG. 5.

With this, the transistors Q2 and J2 for precharging respectively apply VDD/2 as an intermediate electric potential to the output nodes IP and IN via the polarity changeover switch circuit SW as illustrated in FIG. 10B in the process CY2, and thus, these output nodes IP and IN are precharged. Accordingly, in the process CY2, the electric potential of the output node IP that has been in the VDD state until immediately therebefore is gradually decreased as illustrated in FIG. 5 to reach VDD/2 as the precharged electric potential. Note that the output node IN maintains its state as illustrated in FIG. 5, since the output node IN has been originally in the VDD/2 state.

Afterwards, the precharge signal PC transitions from the logical level 1 to the logical level 0 state, and the inverted precharge signal PCX transitions from the logical level 0 to the logical level 1 state (a process CY3). In response to the precharge signal PC of the logical level 0 and the inverted precharge signal PCX of the logical level 1, the transistors Q1 and J1 are turned into the ON state, and the transistors Q2 and J2 for precharging are turned into the OFF state as illustrated in FIG. 10C.

At the timing of, what is called, the rising edge where the inverted precharge signal PCX is transitioned to the logical level 1, the polarity inversion signal POL is transitioned from the logical level 0 to the logical level 1 as illustrated in FIG. 5. Accordingly, in response to the polarity inversion signal POL of the logical level 1, the polarity changeover switch circuit SW performs the polarity switching that couples the relay node LP to the output node IN and couples the relay node LN to the output node IP as illustrated in FIG. 10C.

This turns both the electric potentials of the relay nodes LP and LN to VDD/2 as the electric potentials of the output nodes IP and IN after the above-described precharging as illustrated in FIG. 10C in the process CY3. That is, every time the polarity switching is performed, the precharge circuit PRO performs the above-described precharging immediately before the polarity switching, and thus, both the electric potentials of the relay nodes LP and LN and the output nodes IP and IN are always turned to VDD/2 immediately after the polarity switching by the polarity changeover switch circuit SW.

The minimum electric potential applied to an input end of the decoder DE1 is VDD/2 as the electric potential of the positive gradation voltage X1, and the maximum electric potential is the electric potential VDD of the positive gradation voltage X256. Accordingly, even though VDD/2 as the electric potential of the output node IP or IN by the above-described precharging is applied to an output end of the decoder DE1 immediately after the polarity switching, the electric potential difference between the input and output of the decoder DE1 is VDD/2 at the maximum. Therefore, even immediately after the polarity switching, the voltage that exceeds the withstand voltage (VDD/2) of each transistor that configures the decoder DE1 is not applied to the decoder DE1.

Similarly, the minimum electric potential applied to an input end of the decoder DE2 is the electric potential VSS (0 volts) of the negative gradation voltage Y256 and the maximum electric potential is VDD/2 of the negative gradation voltage Y1. Accordingly, even though VDD/2 as the electric potential of the output nodes IP or IN by the above-described precharging is applied to an output end of the decoder DE2 immediately after the polarity switching, the electric potential difference between the input and output of the decoder DE2 is VDD/2 at the maximum. Therefore, even immediately after the polarity switching, the voltage that exceeds the withstand voltage (VDD/2) of each transistor that configure the decoder DE2 is not applied to the decoder DE2.

Thus, with the precharge circuit PRO, immediately after the polarity switching, the voltage between the drain and the source of each transistor that configures the pair of the respective decoders (DE1 and DE2) that receive the voltage in the range of 0 volts to VDD can be reduced to a regulated withstand voltage (VDD/2) or less.

This ensures reducing the reduced product service life caused by the withstand voltage violation since even though the withstand voltage is regulated to VDD/2 in order to downsize a size of each transistor that configures the decoder, the voltage that exceeds the withstand voltage is not applied to this transistor when the polarities are switched. That is, with the present invention, it is possible to reduce the circuit size of the source driver 13 without shortening the product service life.

Note that, in the above-described embodiment, the electric potential of the maximum positive gradation voltage X256 among the positive gradation voltages X1 to X256 received by the decoder DE1 is the power supply potential VDD, and the electric potential of the minimum negative gradation voltage Y256 among the negative gradation voltages Y1 to Y256 received by the decoder DE2 is the ground potential VSS. Furthermore, in the above-described embodiment, the above-described intermediate electric potential is VDD/2.

However, the intermediate electric potential is not necessarily VDD/2 as long as it is an electric potential between the power supply potential VDD and the ground potential VSS, and the power supply potential VDD and the ground potential VSS may be other respective electric potentials.

In short, as the source driver 13 illustrated in FIG. 2, that is, a display driver that drives a display device (20) in accordance with the plurality of pixel data pieces (P1 to Pn) that indicate the respective luminance levels of the respective pixels based on the image signal (VPD), it is only necessary to include a plurality of the following driving blocks.

That is, each of the driving blocks (CB) receives a pair of the pixel data pieces (for example, P1 and P2) among the plurality of pixel data pieces (P1 to Pn), and generates a pair of drive signals (for example, G1 and G2) having electric potentials corresponding to respective luminance levels indicated by the pair of pixel data pieces to output them to the display device (20). Note that each of the driving blocks (CB) includes the first and second decoders, the polarity changeover switch circuit, the precharge circuit, and the first and second amplifier described below.

The first decoder (DE1) receives the plurality of positive gradation voltages (for example, X1 to X256) each having the electric potential in a range from a third electric potential (for example, VDD/2) between first and second electric potentials (for example, VDD and VSS) that are mutually different to the first electric potential (for example, VDD). A positive gradation voltage that corresponds to one (for example, P1) of the pair of pixel data pieces (for example, P1 and P2) among the plurality of these positive gradation voltages is selected and output to the first input node (DP).

The second decoder (DE2) receives the plurality of negative gradation voltages (for example, Y1 to Y256) each having electric potentials in a range from the above-described third electric potential (for example, VDD/2) to the second electric potential (for example, VSS). A negative gradation voltage that corresponds to the other (for example, P2) of the above-described pair of pixel data pieces among the plurality of these negative gradation voltages is selected and output to the second input node (DN).

The polarity changeover switch circuit (SW) performs the polarity switching process that switches between a state where an electric potential (for example, d1) of the first input node is supplied to the first output node (IP) and an electric potential (for example, d2) of the second input node is supplied to the second output node (IN) and a state where the electric potential of the first input node is supplied to the second output node and the electric potential of the second input node is supplied to the first output node.

The precharge circuit (PRO) precharges the first and second output nodes with the third electric potential (for example, VDD/2) immediately before at the time point where the polarity switching process starts at every polarity switching process by the polarity changeover switch circuit. The first and second amplifiers (for example, AM1 and AM2) generate a pair of drive signals (for example, G1 and G2) by individually amplifying the respective electric potentials of the first and second output nodes.

In the above-described embodiment, the source driver 13 simultaneously applies outputs of all channels, that is, the pixel drive signals G1 to Gn to the display device 20 at every one horizontal scanning period.

However, in association with an increase in size of the display device 20, there is generated a delay until the gate pulse reaches positions of all the source lines D1 to Dn since the gate pulse is output from the gate driver 12 to the horizontal scanning line S of the display device 20. As the source line D is positioned far from the gate driver 12, the delay period increases.

Therefore, the source driver 13 performs driving that shifts a timing to invert polarities and output the respective pixel drive signals G1 to Gn by corresponding to the respective delay periods from the gate pulse is output from the gate driver 12 until reaching to the positions of the respective source lines D1 to Dn.

For example, in the configuration illustrated in FIG. 1, D1 is arranged at the position closest to the gate driver 12 among the source lines D1 to Dn, and Dn is arranged at the position farthest from the gate driver 12. Accordingly, for example, the source driver 13 outputs the pixel drive signal G2 corresponding to the second channel after delaying for a predetermined time after the pixel drive signal G1 corresponding to the first channel is output, and continuously, outputs the pixel drive signal G3 corresponding to a third channel after delaying for the predetermined time.

However, concurrently precharging all the channels in response to the precharge signal PC as illustrated in FIG. 5 while executing such driving applies the output electric potential of the decoder DE1 (DE2) again to the output node IP (IN) of a channel having a delayed timing for the polarity inversion and the output after the precharging is terminated to increase its electric potential.

Accordingly, the input nodes DP and DN and the output nodes IP and IN of the channel are possibly turned into a state similar to those in FIG. 9A and FIG. 9B, and there is caused a failure that the voltage exceeding the withstand voltage (VDD/2) of the transistors configuring the decoder is applied.

Figure 11:
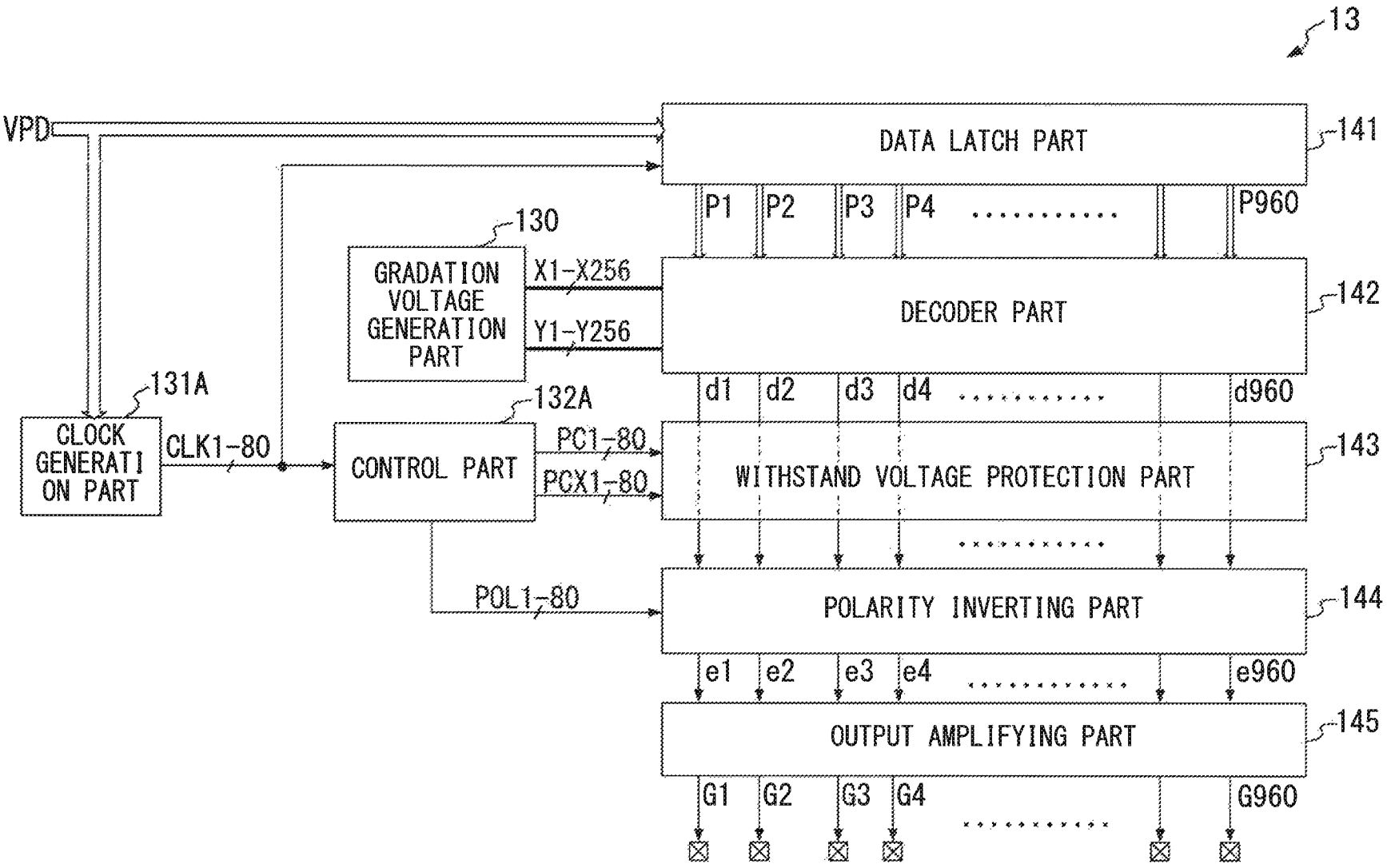
FIG. 11 is a block diagram illustrating another configuration of the display apparatus including the display driver according to the present invention.

FIG. 11 is a block diagram illustrating another internal configuration of the source driver 13 configured to solve such a failure.

In the configuration illustrated in FIG. 11, internal configurations of other modules (130, and 141 to 145) are the same as those in FIG. 2 except that a clock generation part 131A is employed instead of the clock generation part 131, and a control part 132A is employed instead of the control part 132. In the configuration illustrated in FIG. 11, the number of channels of the source driver 13 is 960. That is, the configuration illustrated in FIG. 11 is configured of 480 driving blocks CB that are in charge of driving the 960 channels that individually perform the above-described process to each piece of the pixel data P1 to P960 to generate pixel drive signals G1 to G960.

Figure 12:
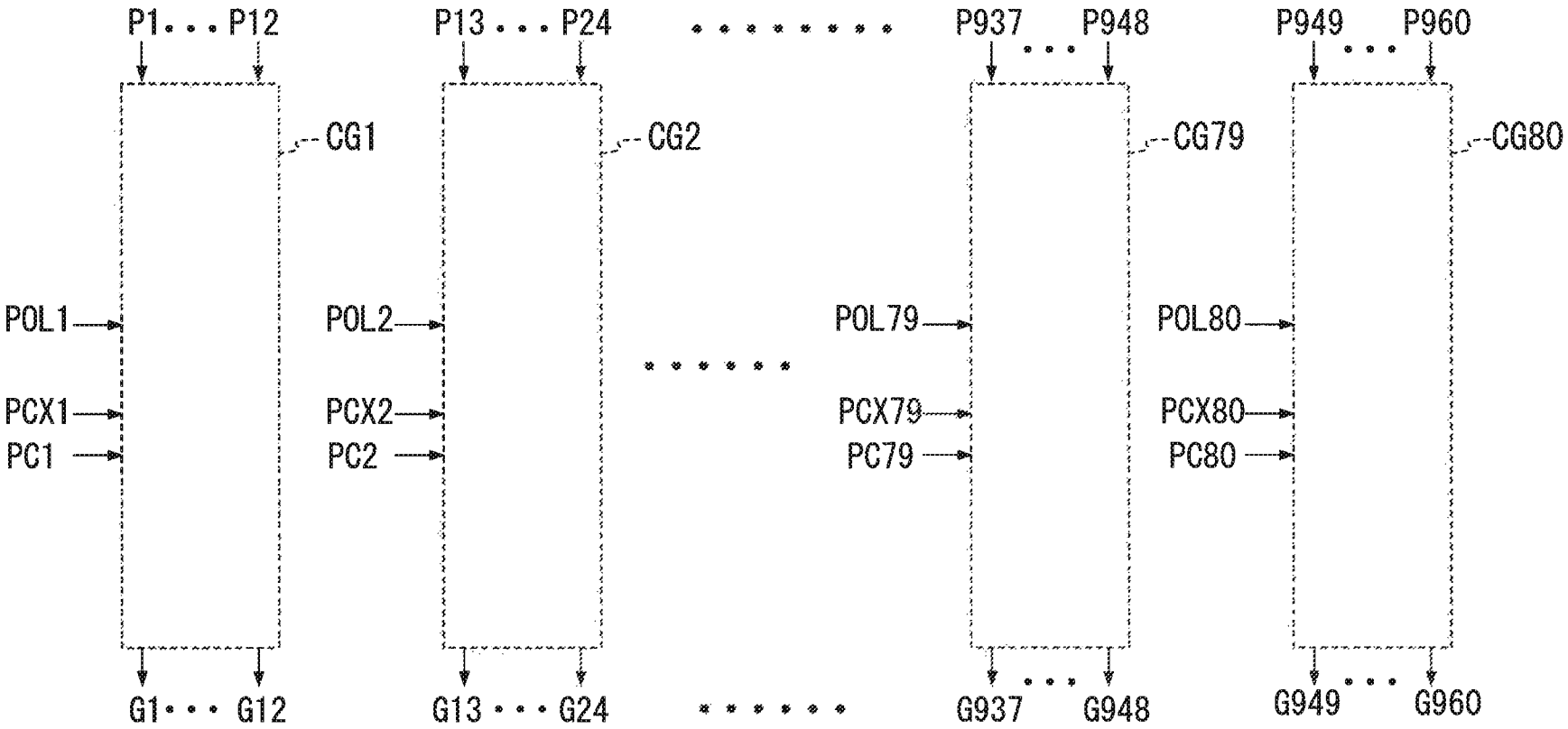
FIG. 12 is a drawing illustrating groups CG1 to CG80 that divide the decoder part, the polarity inverting part, the withstand voltage protection part, and the output amplifying part into 80 pieces.

Furthermore, in the configuration illustrated in FIG. 11, the 960 channels are divided into groups CG1 to CG80 as illustrated in FIG. 12 each formed of the K (K is an even number equal to or more than two) number of driving blocks CB, for example, six driving blocks CB for 12 channels. For each group CG, an output delay, of the pixel drive signal G and execution timing for precharging and polarity inversion are controlled.

Figure 13:
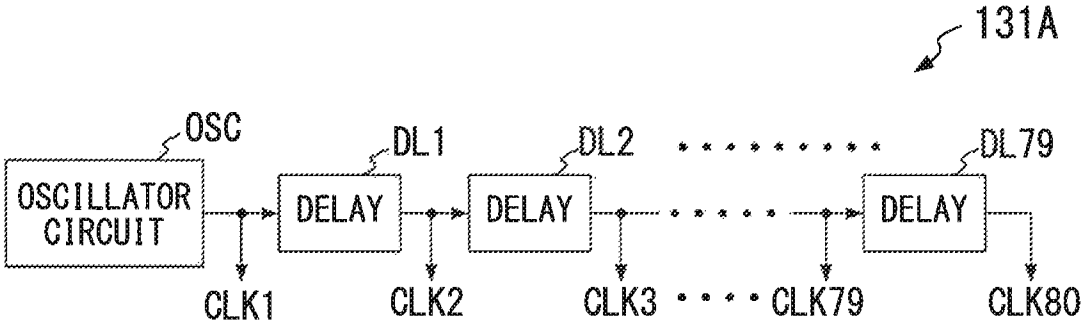
FIG. 13 is a circuit diagram illustrating an internal configuration of a clock generation part.

FIG. 13 is a block diagram illustrating an exemplary internal configuration of a clock generation part 131A. As illustrated in FIG. 13, the clock generation part 131A includes an oscillator circuit OSC and delay circuits DL1 to DL79.

The oscillator circuit OSC generates the clock signal CLK1 in which one pulse appears at each predetermined cycle on the basis of clock information included in the video data signal VPD similarly to the clock generation part 131. The delay circuits DL1 to DL79 are coupled in cascade as illustrated in FIG. 13. The delay circuit DL1 at the head sets the clock signal CLK1 delayed for a predetermined period as a clock signal CLK2, and supplies the clock signal CLK2 to the delay circuit DL2 at the next stage. The delay circuit DL2 sets the clock signal CLK2 delayed for the predetermined period as a clock signal CLK3, and supplies the clock signal CLK3 to the delay circuit DL3 at the next stage. Similarly, each of the delay circuits DL3 to DL78 supplies the clock signal CLK supplied from the delay circuit at the former stage delayed for the predetermined period to the delay circuit DL at the next stage. The delay circuit DL79 at the final stage outputs a clock signal CLK79 supplied from the delay circuit DL78 at the former stage delayed for the predetermined period as a clock signal CLK80.

The clock generation part 131A supplies the clock signals CLK1 to CLK80 generated as described above to the control part 132A and the data latch part 141.

Figure 14:
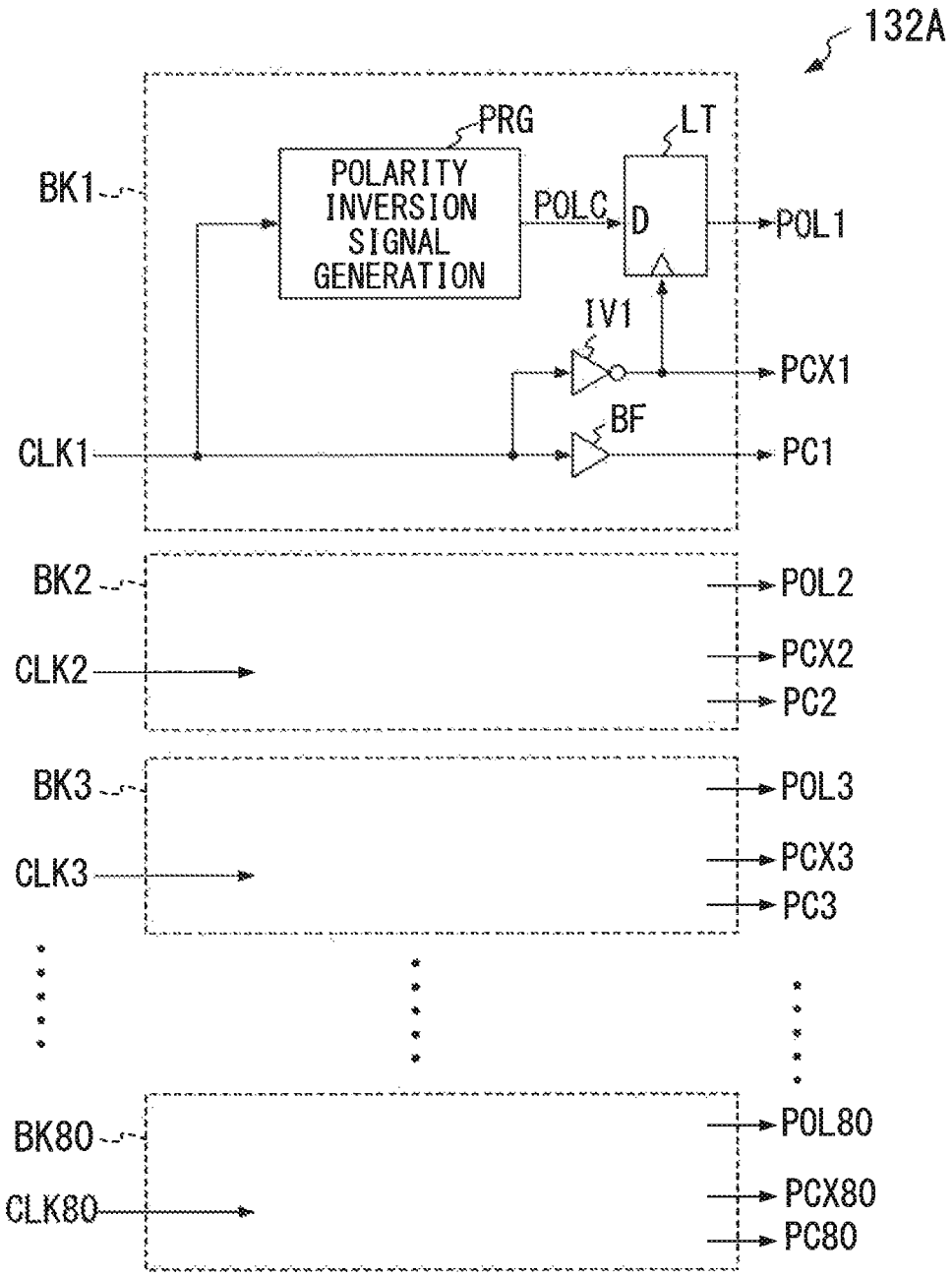
FIG. 14 is a block diagram illustrating an internal configuration of the control part.

FIG. 14 is a block diagram illustrating an exemplary internal configuration of the control part 132A.

As illustrated in FIG. 14, the control part 132A includes control blocks BK1 to BK80 that each has the inverter IV1, the polarity inversion signal generation part PRG, and the latch LT similarly to the control part 132 illustrated in FIG. 4. Note that each of the control blocks BK1 to BK80 includes a buffer BF instead of the pulse generation part PSG illustrated in FIG. 4. The control blocks BK1 to BK80 receive the clock signals CLK1 to CLK80.

The control block BK1 outputs the polarity inversion signal POL generated by the clock signal CLK1 as POL1 similarly to the control part 132 illustrated in FIG. 4. In the control block BK1, the buffer BF receives the clock signal CLK1, and outputs the clock signal CLK1 as the precharge signal PC1, and the inverter IV1 outputs a signal that is the clock signal CLK1 whose logical level is inverted as the inverted precharge signal PCX1. Similarly, the control block BKj (j is an integer from 2 to 80) outputs the polarity inversion signal POL generated by a clock signal CLKj as POLj, the clock signal CLKj as a precharge signal PCj, and a signal that is the clock signal CLKj whose logical level is inverted as an inverted precharge signal PCXj.

That is, the control part 132A generates the polarity inversion signals POL1 to POL80, the precharge signals PC1 to PC80, and the inverted precharge signals PCX1 to PCX80 corresponding to the group CG1 to CG80 illustrated in FIG. 12 by the above-described process.

The control part 132A supplies the polarity inversion signals POL1 to POL80 to the polarity inverting part 144. That is, the control part 132A supplies the polarity inversion signals POL1 to POL80 to the corresponding respective groups CG1 to CG80 as illustrated in FIG. 12.

Furthermore, the control part 132A supplies the precharge signals PC1 to PC80 and the inverted precharge signals PCX1 to PCX80 to the withstand voltage protection part 143. That is, the control part 132A supplies the precharge signals PC1 to PC80 and the inverted precharge signals PCX1 to PCX80 to the corresponding respective groups CG1 to CG80 as illustrated in FIG. 12.

Figure 15:
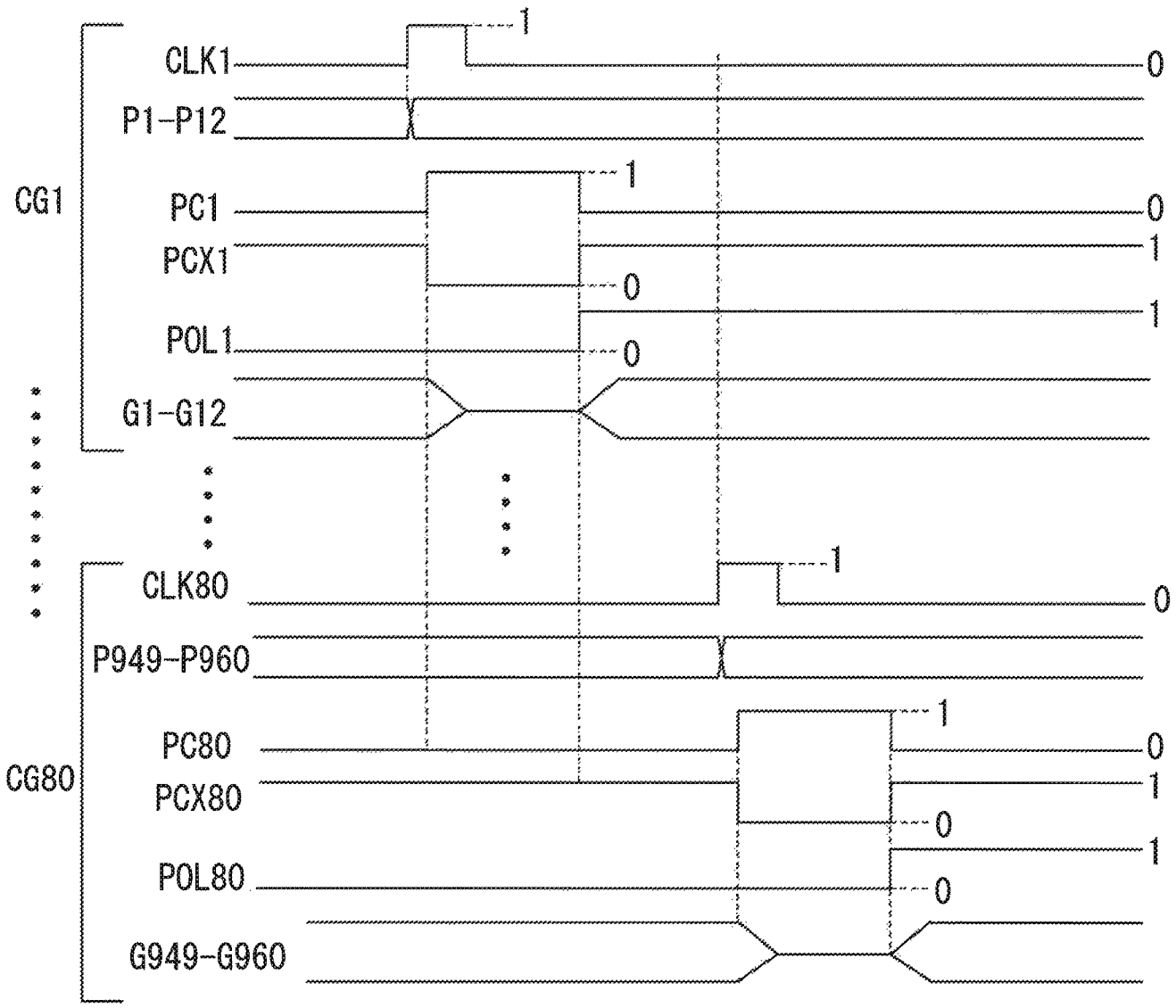
FIG. 15 is a timing chart that illustrates timings of various kinds of signals and output timings of the pixel drive signals supplied respectively to the groups CG1 and CG80 in comparison.

With this, for example, the group CG1 outputs the pixel drive signals G1 to G12 corresponding to the pixel data P1 to P12 at a timing when the synchronization to the clock signal CLK1 illustrated in FIG. 15 is made.

The precharge circuits PRO of the respective driving blocks CB corresponding to first to twelfth channels belonging to the group CG1 performs the above-described precharging in response to the precharge signal PC1 and the inverted precharge signal PCX1 illustrated in FIG. 15. Immediately after the termination of such precharging, continuously, the polarity changeover switch circuits SW of the respective driving blocks corresponding to the first to twelfth channels belonging to the group CG1 performs the polarity switching process in response to the polarity inversion signal POL1 illustrated in FIG. 15.

For example, in the group CG80, as illustrated in FIG. 15, the driving block corresponding to 949th to 960th channels belonging to this CG80 outputs pixel drive signals G949 to G960 corresponding to pixel data P949 to P960 at a timing of the clock signal CLK80 delayed more than the clock signal CLK1.

The precharge circuits PRO of the respective driving blocks CB corresponding to the 949th to 960th channels belonging to the group CG80 performs the above-described precharging in response to the precharge signal PC80 and the inverted precharge signal PCX80 illustrated in FIG. 15. Immediately after the termination of such precharging, the polarity changeover switch circuits SW of the respective driving blocks CB corresponding to the 949th to 960th channels belonging to the group CG80 performs the polarity switching process in response to the polarity inversion signal POL80 illustrated in FIG. 15.

Figure 16:
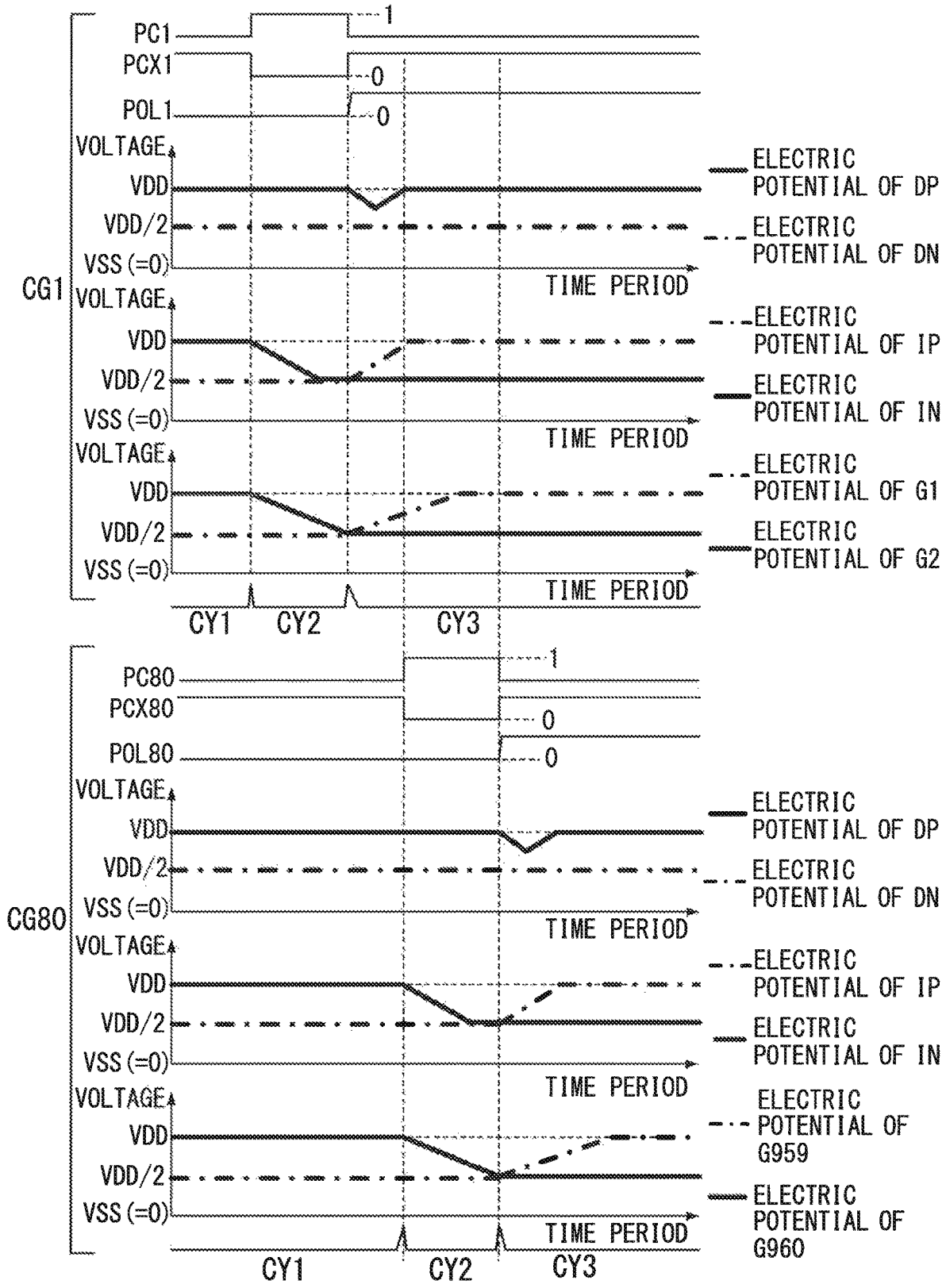
FIG. 16 is a timing chart illustrating one example of electric potential waveforms and waveforms of the pixel drive signals in respective polarity inverting parts of the groups CG1 and CG80.

Accordingly, as illustrated in FIG. 16, in the driving blocks corresponding to the first to twelfth channels belonging to the group CG1, first, precharging by the precharge signal PC1 and PCX1 sets the output nodes IP and IN to VDD/2 (CY2). In the group CG1, the polarity switching is performed by the polarity inversion signal POL1 immediately after this precharging operation is terminated (CY3). In view of this, it is avoided that the voltage exceeding the withstand voltage (VDD/2) of each transistor configuring the decoders (DE1 and DE2) is applied to the decoder immediately after the polarity switching, similarly to the case illustrated in FIG. 5.

In the group CG80 that outputs the pixel drive signals G949 to G960 at the timing later than the group CG1 as illustrated in FIG. 15, precharging by the precharge signals PC80 and PCX80 sets the output nodes IP and IN to VDD/2 as illustrated in FIG. 16 (CY2). In this group CG1, the polarity switching is performed in response to the polarity inversion signal POL80 immediately after this precharging operation is terminated (CY3).

Thus, in the configuration illustrated in FIG. 11, as each one outputs the respective pixel drive signals G with respective different delay periods for each group CG including the six driving blocks CB for 12 channels, the above-described precharging and polarity switching are continuously executed at the output timings of the pixel drive signal G for each group CG. That is, every time the polarity switching is performed, the above-described precharging is performed immediately before the polarity switching. This ensures reducing the voltage applied to the transistors included in the decoder lower than the regulated withstand voltage, even though the output timing of the pixel drive signal G is different for each group CG.

Note that, while in the configuration illustrated in FIG. 11, the six driving blocks CB for 12 channels configure one group CG, the number of the driving blocks CB included in each group CG is not limited to six.

In short, in the configuration illustrated in FIG. 11, it is only necessary that n/2 driving blocks CB in charge of driving for one horizontal scanning line are divided into the plurality of groups CG each formed of the K (K is an integer equal to or more than two) driving blocks CB. The plurality of driving blocks output the respective pixel drive signals G to the display device 20 at the output timing different by each group CG. It is only necessary that the precharge circuit PRO and the polarity changeover switch circuit SW that belong to the group continuously execute the precharging and the polarity switching process for each group CG by following the output timing for each group CG.

What is claimed is:

1. A display driver that drives a display device in accordance with a plurality of pixel data pieces indicating respective luminance levels of respective pixels corresponding to an image signal, the display driver comprising:

a plurality of driving blocks each of which receives a pair of pixel data pieces among the plurality of pixel data pieces, and generates a pair of drive signals having respective electric potentials corresponding to luminance levels indicated by the pair of pixel data pieces to output the pair of drive signals to the display device, wherein each of the driving blocks includes:

a first decoder that receives a plurality of positive gradation voltages each of which has an electric potential in a range from a third electric potential between first and second electric potentials that are mutually different to the first electric potential, and selects a positive gradation voltage corresponding to one of the pair of pixel data pieces among the plurality of positive gradation voltages to output the positive gradation voltage to a first input node;

a second decoder that receives a plurality of negative gradation voltages each of which has an electric potential in a range from the third electric potential to the second electric potential, and selects a negative gradation voltage corresponding to another one of the pair of pixel data pieces among the plurality of negative gradation voltages to output the negative gradation voltage to a second input node;

a polarity changeover switch circuit that performs a polarity switching process that switches between a state in which the electric potential of the first input node is supplied to a first output node and the electric potential of the second input node is supplied to a second output node and a state in which the electric potential of the first input node is supplied to the second output node and the electric potential of the second input node is supplied to the first output node;

a precharge circuit that precharges the first and second output nodes with the third electric potential before the polarity switching process by the polarity changeover switch circuit; and first and second amplifiers that generate the pair of drive signals by individually amplifying the respective electric potentials of the first and second output nodes.

2. The display driver according to claim 1, wherein the precharge circuit is coupled between each of the first and second input nodes and the polarity changeover switch circuit;

the polarity changeover switch circuit is coupled between the precharge circuit and each of the first and second output nodes.

3. The display driver according to claim 1, wherein the driving blocks are divided into groups each of which is formed of the K (K is an integer equal to or more than two) number of driving blocks, the driving blocks output the drive signals at an output timing different for each of the groups to the display device, and the precharging by the precharge circuit and the polarity switching process by the polarity changeover switch circuit belonging to a group for each of the groups are continuously executed by following the output timing for each of the groups.

4. The display driver according to claim 1, wherein the first and second decoders are configured of MOS transistors whose respective drain-source withstand voltages are regulated to the third electric potential.

5. The display driver according to claim 1, wherein the precharge circuit precharges the first and second output nodes by applying the first and second output nodes with the third electric potential via the polarity changeover switch circuit in a state where an electrical connection between each of the first and second input nodes and the polarity changeover switch circuit is cut off during a predetermined period immediately before the polarity switching process.

6. The display driver according to claim 1, wherein the first electric potential is higher than the second electric potential, the display driver includes a control part that generates a precharge signal having a logical level 1 that prompts an execution of the precharging or a logical level 0 that prompts non-execution, and an inverted precharge signal that is the precharge signal whose logical levels are inverted, the precharge circuit includes:

a first p channel MOS transistor that receives the precharge signal at a gate, the first p channel MOS transistor having a source and a drain coupled to the first input node and the polarity changeover switch circuit, respectively;

a second p channel MOS transistor that receives the inverted precharge signal at a gate, the second p channel MOS transistor having a source applied with the third electric potential and a drain coupled to the polarity changeover switch circuit;

a first n channel MOS transistor that receives the inverted precharge signal at a gate, the first n channel MOS transistor having a drain and a source coupled to the second input node and the polarity changeover switch circuit, respectively; and a second n channel MOS transistor that receives the precharge signal at a gate, the second n channel MOS transistor having a source applied with the third electric potential and a drain coupled to the polarity changeover switch circuit.

7. A semiconductor apparatus in which a display driver that drives a display device in accordance with a plurality of pixel data pieces indicating respective luminance levels of respective pixels based on an image signal is formed, wherein the display driver comprises a plurality of driving blocks each of which receives a pair of pixel data pieces among the plurality of pixel data pieces, and generates a pair of drive signals having respective electric potentials corresponding to luminance levels indicated by the pair of pixel data pieces to output the pair of drive signals to the display device, wherein each of the driving blocks includes:

a first decoder that receives a plurality of positive gradation voltages each of which has an electric potential in a range from a third electric potential between first and second electric potentials that are mutually different to the first electric potential, and selects a positive gradation voltage corresponding to one of the pair of pixel data pieces among the plurality of positive gradation voltages to output the positive gradation voltage to a first input node;

a second decoder that receives a plurality of negative gradation voltages each of which has an electric potential in a range from the third electric potential to the second electric potential, and selects a negative gradation voltage corresponding to another one of the pair of pixel data pieces among the plurality of negative gradation voltages to output the negative gradation voltage to a second input node;

a polarity changeover switch circuit that performs a polarity switching process that alternatively switches between a state in which the electric potential of the first input node is supplied to a first output node and the electric potential of the second input node is supplied to a second output node and a state in which the electric potential of the first input node is supplied to the second output node and the electric potential of the second input node is supplied to the first output node;

a precharge circuit that precharges the first and second output nodes with the third electric potential before the polarity switching process by the polarity changeover switch circuit; and first and second amplifiers that generate the pair of drive signals by individually amplifying the respective electric potentials of the first and second output nodes.

* * * * *